US011446803B2

(12) United States Patent
Yasutomi

(10) Patent No.: US 11,446,803 B2
(45) Date of Patent: Sep. 20, 2022

(54) DRIVER

(71) Applicant: KOKI HOLDINGS CO., LTD., Tokyo (JP)

(72) Inventor: Toshinori Yasutomi, Ibaraki (JP)

(73) Assignee: KOKI HOLDINGS CO., LTD., Tokyo (JP)

( * ) Notice: Subject to any disclaimer, the term of this patent is extended or adjusted under 35 U.S.C. 154(b) by 229 days.

(21) Appl. No.: 16/971,563

(22) PCT Filed: Jan. 25, 2019

(86) PCT No.: PCT/JP2019/002480
§ 371 (c)(1),
(2) Date: Aug. 20, 2020

(87) PCT Pub. No.: WO2019/167497
PCT Pub. Date: Sep. 6, 2019

(65) Prior Publication Data

US 2020/0398412 A1 Dec. 24, 2020

(30) Foreign Application Priority Data

Feb. 28, 2018 (JP) ..... JP2018-035827

(51) Int. Cl.
*B25C 1/04* (2006.01)
*B25C 1/00* (2006.01)

(52) U.S. Cl.
CPC ..... *B25C 1/047* (2013.01); *B25C 1/008* (2013.01)

(58) Field of Classification Search
CPC ..... B25C 1/047; B25C 1/041; B25C 1/042; B25C 1/043; B25C 1/046; B25C 1/04; B25C 1/008
See application file for complete search history.

(56) References Cited

U.S. PATENT DOCUMENTS 3,771,710 A * 11/1973 Perkins ..... B25C 1/043 227/130
2010/0276467 A1 11/2010 Kramer
(Continued)

FOREIGN PATENT DOCUMENTS

JP 2002-346946 A 12/2002
WO 2017/115593 A1 7/2017
WO 2017/187892 A1 11/2017

OTHER PUBLICATIONS

International Search Report issued in corresponding International Patent Application No. PCT/JP2019/002480, dated Mar. 12, 2019, with English translation.

*Primary Examiner* — Anna K Kinsaul
*Assistant Examiner* — Veronica Martin
(74) *Attorney, Agent, or Firm* — McDermott Will & Emery LLP

(57) ABSTRACT

A driver includes a pressure chamber, a striking portion, an operation member, and a contact member, and can select a first mode and a second mode. The driver further includes a first ventilation passage, a second ventilation passage, and opening/closing mechanisms. The opening/closing mechanisms have a first state to open the first ventilation passage and close the second ventilation passage in the first mode, a second state, when an operation force is applied to the operation member within a time from when the second mode is selected and the contact member contacts a workpiece, to close the first ventilation passage and open the second ventilation passage, and a third state, when an operation force is applied to the operation member within a time from when the second mode is selected and the contact member is separated from the workpiece, to close the second ventilation passage.

9 Claims, 14 Drawing Sheets

(56) References Cited

U.S. PATENT DOCUMENTS

| | | | | |
|---|---|---|---|---|
| 2011/0266327 | A1* | 11/2011 | Wu | B25C 1/047 227/8 |
| 2015/0197001 | A1* | 7/2015 | Li | B25C 1/047 227/130 |
| 2016/0151900 | A1* | 6/2016 | Wu | B25C 1/047 227/130 |
| 2019/0022842 | A1 | 1/2019 | Oouchi | |
| 2019/0111552 | A1 | 4/2019 | Nagao | |

* cited by examiner

10: DRIVER
13: STRIKING PORTION
14: OPERATION MEMBER
16: CONTACT MEMBER
36: PRESSURE CHAMBER
57: FIRST VENTILATION PASSAGE
106: SECOND VENTILATION PASSAGE
107, 110: OPENING/CLOSING MECHANISM

DRIVER

CROSS REFERENCE TO RELATED APPLICATIONS

This application is the U.S. National Phase under 35 U.S.C. § 371 of International Patent Application No. PCT/JP2019/002480, filed on Jan. 25, 2019, which claims the benefits of Japanese Patent Application No. 2018-035827, filed on Feb. 28, 2018 the entire contents of which are hereby incorporated by reference.

TECHNICAL FIELD

The present invention relates to a driver having a pressure chamber and a striking portion that is actuated in a direction of striking a fastener when compressed gas is supplied to the pressure chamber.

BACKGROUND ART

A driver having a pressure chamber and a striking portion that is actuated in a direction of striking a fastener when compressed gas is supplied to the pressure chamber has been known. The driver described in Patent Document 1 has a housing, a pressure accumulation chamber, a pressure chamber, a striking portion, a push lever, a cylinder, a trigger, a trigger valve, an ejection portion, a magazine, and a delay valve as a switching mechanism. The pressure accumulation chamber is provided in the housing, and compressed air is supplied to the pressure accumulation chamber. The pressure chamber and the striking portion are provided in the housing, and the striking portion is provided so as to be actuated in the housing. The cylinder is provided so as to be actuated in the housing, and the cylinder connects and disconnects the pressure chamber and the pressure accumulation chamber. The trigger is rotatably attached to the housing. The push lever is provided so as to be actuated on the housing. The ejection portion is fixed to the housing, and the ejection portion has an ejection path. The magazine stores fasteners and the magazine supplies the fasteners to the ejection path.

In the driver described in Patent Document 1, the cylinder disconnects the pressure accumulation chamber and the pressure chamber unless at least one of the conditions that an operation force is applied to the trigger and an operation force is applied to the push lever is satisfied. The compressed air of the pressure accumulation chamber is not supplied to the pressure chamber, and the striking portion is stopped at the top dead center. Namely, the striking portion is not actuated in the direction of striking the fastener.

In the driver described in Patent Document 1, the trigger valve is actuated and the cylinder is actuated to connect the pressure accumulation chamber and the pressure chamber when both of the conditions that the operation force is applied to the trigger and the operation force is applied to the push lever are satisfied. The compressed air of the pressure accumulation chamber is supplied to the pressure chamber, and the striking portion is actuated in the direction of striking the fastener.

A worker can select a first mode and a second mode using a driver. The first mode is a mode in which a worker applies an operation force to a trigger while applying an operation force to a push lever. The second mode is a mode in which a worker applies an operation force to a push lever while applying an operation force to a trigger.

In the driver described in Patent Document 1, for a predetermined time from when the second mode is selected and the operation force is applied to the trigger, the delay valve connects the passage to supply the compressed gas of the pressure accumulation chamber to the pressure chamber. Therefore, if the operation force is applied to the push lever within the predetermined time from when the operation force is applied to the trigger, compressed air is supplied to the pressure chamber, and the striking portion is actuated in the direction of striking the fastener.

On the other hand, when the predetermined time has elapsed from the time when the operation force is applied to the trigger, the delay valve disconnects the passage to supply the compressed gas of the pressure accumulation chamber to the pressure chamber. Therefore, the compressed air is not supplied to the pressure chamber even if the operation force is applied to the push lever after the predetermined time has elapsed from the time when the operation force is applied to the trigger in the second mode. Namely, the striking portion is not actuated in the direction of striking the fastener. The delay valve described in Patent Document 1 is actuated by compressed gas.

RELATED ART DOCUMENTS

Patent Documents

Patent Document 1: International Patent Application Publication No. 2017-115593

SUMMARY OF THE INVENTION

Problem to be Solved by the Invention

The inventor of this application has recognized that there is a possibility that, when a delay valve malfunctions, the striking portion cannot be actuated in the direction of striking the fastener not only in the case where the second mode is selected but also in the case where the first mode is selected.

An object of the present invention is to provide a driver capable of preventing the striking portion from being unable to be actuated in the direction of striking the fastener.

Means for Solving the Problems

A driver according to an embodiment includes a pressure chamber, a striking portion actuated in a direction of striking a fastener when compressed gas is supplied to the pressure chamber, an operation member to which a worker applies an operation force, and a contact member brought into contact with a workpiece by the worker, the driver can select a first mode in which, when the worker applies an operation force to the operation member while the worker brings the contact member into contact with the workpiece, the compressed gas is supplied to the pressure chamber and the striking portion is actuated in the direction of striking the fastener, and a second mode in which, when the worker brings the contact member into contact with the workpiece while the worker applies an operation force to the operation member, the compressed gas is supplied to the pressure chamber and the striking portion is actuated in the direction of striking the fastener, the driver comprises: a passage for supplying the compressed gas to the pressure chamber; a valve body capable of being actuated and stopped so as to open and close the passage; a control chamber configured to actuate and stop the valve body according to a pressure of the compressed gas; a first ventilation passage which is connected to the control chamber and through which the compressed gas passes; a second ventilation passage which is connected to the control chamber and is disposed in parallel to the first ventilation passage and through which the compressed gas passes; and an opening/closing mechanism configured to separately open and close the first ventilation passage and the second ventilation passage, and the opening/closing mechanism has a first state in which the first ventilation passage is opened and the second ventilation passage is closed when the worker selects the first mode, a second state in which, when an operation force is applied to the operation member within a predetermined time from when the second mode is selected and the contact member is in contact with the workpiece, the first ventilation passage is closed and the second ventilation passage is opened, and a third state in which, when an operation force is applied to the operation member within a predetermined time from when the second mode is selected and the contact member is separated from the workpiece, the second ventilation passage is closed.

Effects of the Invention

According to the driver of the embodiment, it is possible to prevent the striking portion from being unable to be actuated in the direction of striking the fastener.

DETAILED DESCRIPTION OF PREFERRED EMBODIMENTS

Figure 1:
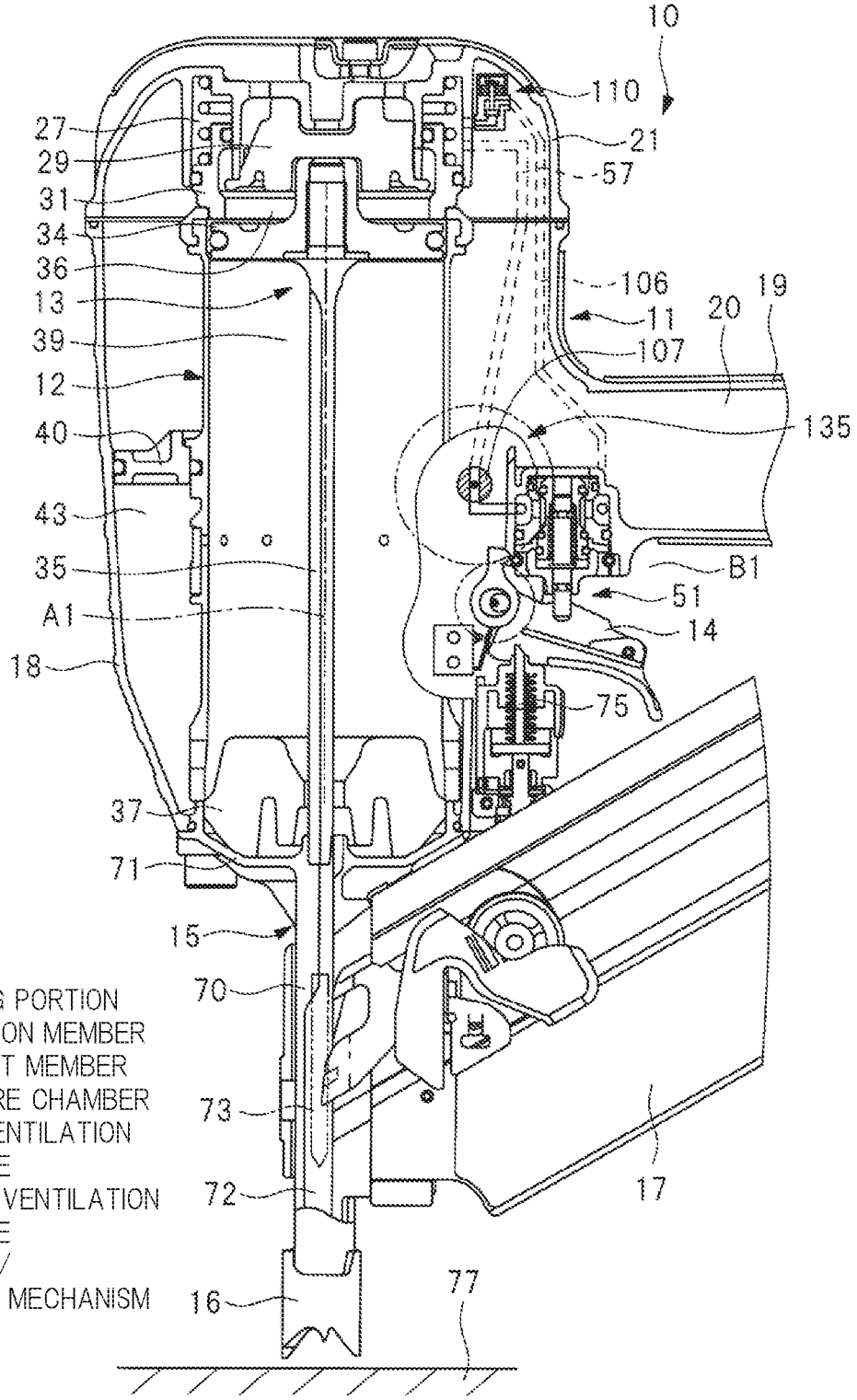
FIG. 1 is a longitudinal cross-sectional view showing an overall configuration of a driver according to an embodiment.

Next, some representative drivers among the drivers according to the embodiments included in the present invention will be described with reference to the drawings.

A driver according to an embodiment will be described with reference to FIG. 1. A driver 10 includes a main body 11, a cylinder 12, a striking portion 13, a trigger 14, an ejection portion 15, and a push lever 16. Also, a magazine 17 is attached to the driver 10. The main body 11 has a tubular body portion 18, a head cover 21 fixed to the body portion 18, and a handle 19 connected to the body portion 18. The handle 19 projects from an outer surface of the body portion 18.

A pressure accumulation chamber 20 is formed across an inside of the handle 19, an inside of the body portion 18, and an inside of the head cover 21. An air hose is connected to the handle 19. Compressed air as compressed gas is supplied into the pressure accumulation chamber 20 through the air hose. The cylinder 12 is provided in the body portion 18. The head cover 21 has an outer tubular portion 22, an inner tubular portion 23, and an exhaust passage 24. The outer tubular portion 22 and the inner tubular portion 23 are arranged concentrically about a center line A1. The inner tubular portion 23 is provided inside the outer tubular portion 22.

A head valve 31 is provided in the head cover 21. The head valve 31 has a cylindrical shape and is arranged between the outer tubular portion 22 and the inner tubular portion 23. The head valve 31 is movable in the direction of the center line A1 of the cylinder 12. Sealing members 25 and 26 are attached to the head valve 31. A control chamber 27 is formed between the outer tubular portion 22 and the inner tubular portion 23. The sealing members 25 and 26 hermetically seal the control chamber 27. A biasing member 28 is provided in the control chamber 27. The biasing member 28 is, for example, a metal compression coil spring.

A stopper 29 is provided in the head cover 21. The stopper 29 is made of, for example, synthetic rubber, and a part of the stopper 29 is arranged inside the inner tubular portion 23. A passage 30 is formed between the inner tubular portion 23 and the stopper 29, and the passage 30 is connected to the exhaust passage 24. The exhaust passage 24 is connected to an outside B1 of the main body 11.

The cylinder 12 is fixed to the body portion 18 so as to be positioned in the direction of the center line A1. In the cylinder 12, a valve seat 32 is attached to an end portion of the cylinder 12 that is closest to the head valve 31 in the direction of the center line A1. The valve seat 32 has an annular shape and is made of synthetic rubber. A port 33 is formed between the head valve 31 and the valve seat 32.

The head valve 31 is constantly biased in a direction away from the valve seat 32 by the pressure from the pressure accumulation chamber 20. The head valve 31 is biased in the direction away from the valve seat 32 by the pressure of the control chamber 27. The biasing member 28 biases the head valve 31 toward the valve seat 32 in the direction of the center line A1. When the head valve 31 is pressed to the valve seat 32, the head valve 31 closes the port 33. When the head valve 31 is separated from the valve seat 32, the head valve 31 opens the port 33.

The striking portion 13 includes a piston 34 and a driver blade 35 fixed to the piston 34. The piston 34 is arranged in the cylinder 12, and the piston 34 is movable in the direction of the center line A1. A sealing member 100 is attached to an outer peripheral surface of the piston 34. An upper piston chamber 36 is formed between the stopper 29 and the piston 34. When the head valve 31 opens the port 33, the pressure accumulation chamber 20 is connected to the upper piston chamber 36. When the head valve 31 closes the port 33, the pressure accumulation chamber 20 is disconnected from the upper piston chamber 36.

The ejection portion 15 is fixed to an end portion of the body portion 18 on a side opposite to the head cover 21 in the direction of the center line A1.

Figure 3:
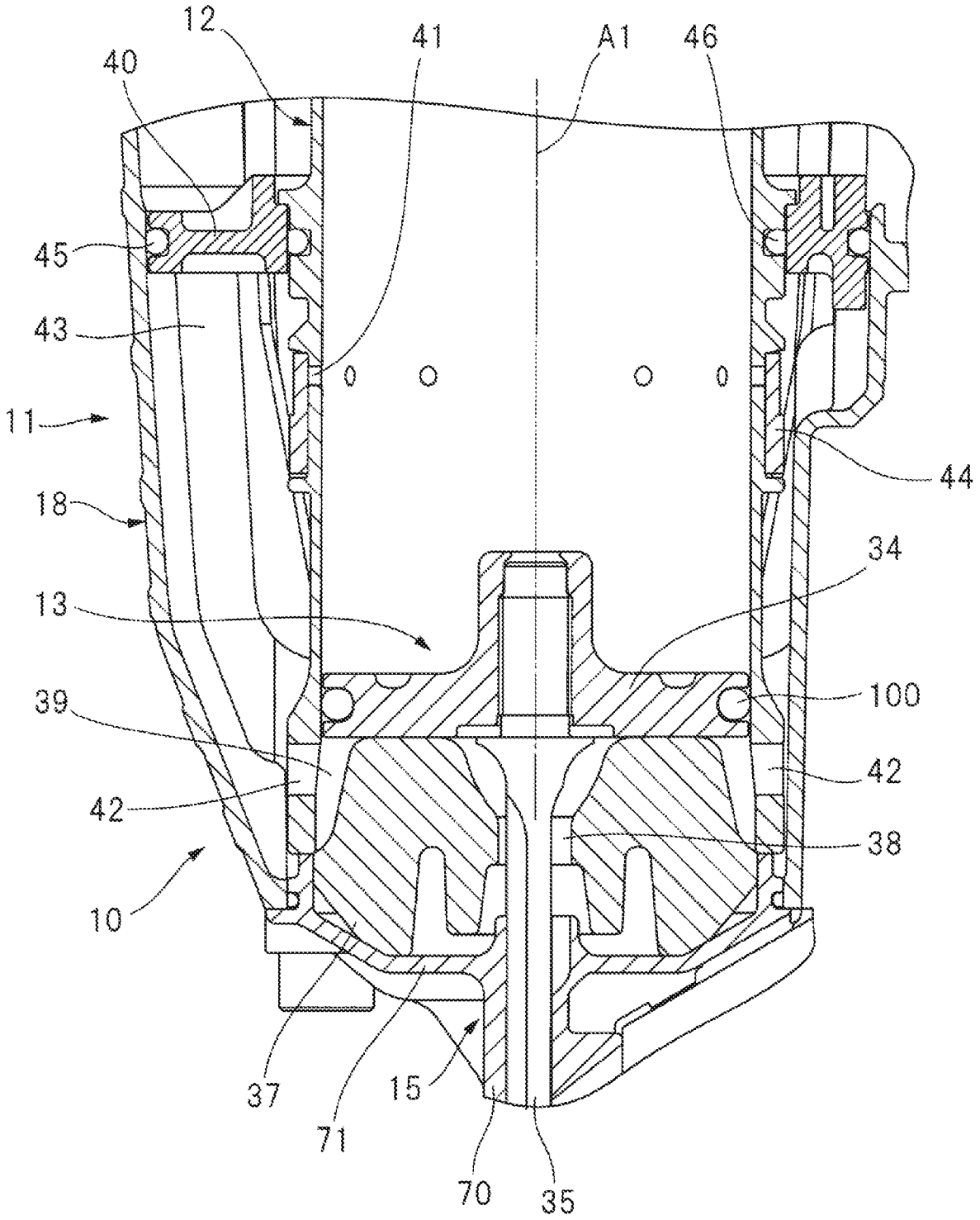
FIG. 3 is a cross-sectional view showing an internal structure of a cylinder of the driver.

As shown in FIG. 1 and FIG. 3, a bumper 37 is provided in the cylinder 12. The bumper 37 is arranged at a position closest to the ejection portion 15 in the direction of the center line A1 in the cylinder 12. The bumper 37 is made of synthetic rubber or silicone rubber. The bumper 37 has a shaft hole 38, and the driver blade 35 is movable in the shaft hole 38 in the direction of the center line A1. In the cylinder 12, a lower piston chamber 39 is formed between the piston 34 and the bumper 37. The sealing member 100 hermetically disconnects the lower piston chamber 39 and the upper piston chamber 36.

A holder 40 is provided in the body portion 18. The holder 40 has a tubular shape. The holder 40 is concentric with the cylinder 12 and is arranged outside the cylinder 12. Passages 41 and 42 penetrating the cylinder 12 in the radial direction are provided. The passage 42 is disposed between the passage 41 and the ejection portion 15 in the direction of the center line A1. A return air chamber 43 is formed between the outer surface of the cylinder 12 and the body portion 18. The passage 41 connects the lower piston chamber 39 and the return air chamber 43. A check valve 44 is provided on the cylinder 12. The check valve 44 opens the passage 41 when the air in the cylinder 12 is to flow into the return air chamber 43. The check valve 44 closes the passage 41 when the air in the return air chamber 43 is to flow into the cylinder 12.

The passage 42 constantly connects the return air chamber 43 and the lower piston chamber 39. Compressed air is enclosed throughout the lower piston chamber 39 and the return air chamber 43. A sealing member 45 is provided between the holder 40 and the body portion 18, and a sealing member 46 is provided between the holder 40 and the cylinder 12. The sealing members 45 and 46 hermetically disconnect the pressure accumulation chamber 20 and the return air chamber 43 from each other.

Figure 4:
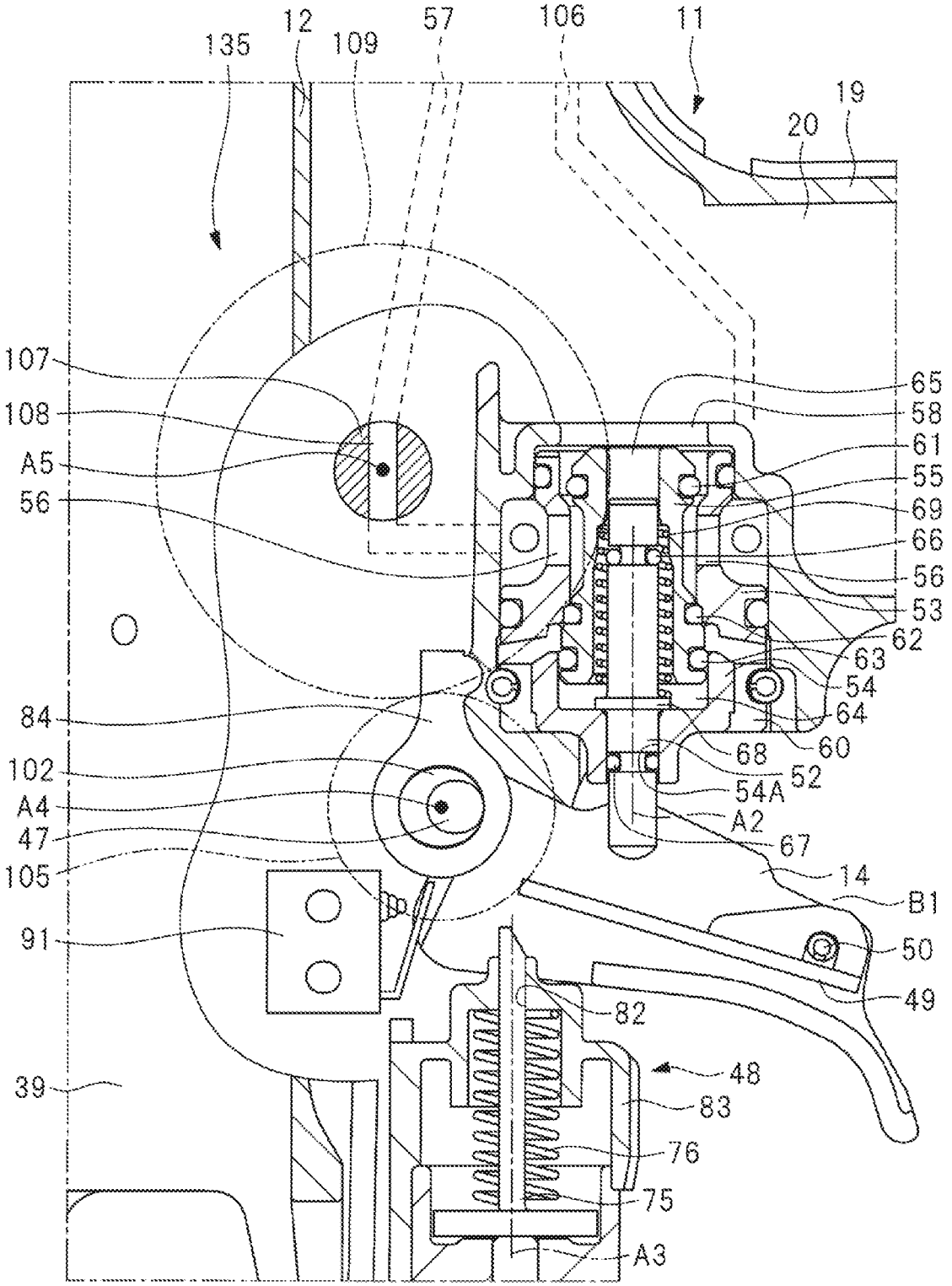
FIG. 4 is a cross-sectional view showing a state in which a first mode is selected in a first specific example of a switching mechanism provided in the driver.

As shown in FIG. 4, the trigger 14 is supported by the main body 11 via a support shaft 47 and a boss portion 103. The boss portion 103 has a columnar shape, and the boss portion 103 is rotatable with respect to the main body 11 about a center line A4. A center of the support shaft 47 is disposed at a position eccentric from the center line A4. A first gear 105 is attached to the boss portion 103. The first gear 105 is rotatable about the center line A4 together with the boss portion 103.

A mode selection member 84 is attached to the boss portion 103. A worker operates the mode selection member 84 to select a driving mode. The driving mode includes a first mode and a second mode. The mode selection member 84 is, for example, a lever or a knob. The mode selection member 84 has a first operation position corresponding to the first mode and a second operation position corresponding to the second mode. The first operation position and the second operation position are positions of the mode selection member 84 in the rotation direction and are different positions from each other.

When the worker applies an operation force to the mode selection member 84, the boss portion 102 and the first gear 105 rotate about the center line A4. When the boss portion 102 rotates, the support shaft 47 revolves about the center line A4. When the worker releases the operation force to the mode selection member 84, the boss portion 102 stops.

The worker holds the handle 19 by hand and applies or releases an operation force to or from the trigger 14 with a finger. The trigger 14 can be actuated within a range of a predetermined angle about the support shaft 47. A biasing member that biases the trigger 14 is provided. The biasing member biases the trigger 14 clockwise about the support shaft 47 in FIG. 4. The biasing member is, for example, a metal spring. A tubular holder 48 is attached to the main body 11. The holder 48 has a guide hole 82 and a support portion 83. The trigger 14 biased by the biasing member comes into contact with the support portion 83 and is stopped at an initial position.

An arm 49 is attached to the trigger 14. The arm 49 can be actuated with respect to the trigger 14 about a support shaft 50 within a range of a predetermined angle. The support portion 83 is disposed between the support shaft 47 and the support shaft 50 in the length direction of the trigger 14. The support shaft 50 is provided in the trigger 14, and the support shaft 50 is provided at a position different from the support shaft 47. A biasing member that biases the arm 49 about the support shaft 50 is provided. The biasing member biases the arm 49 counterclockwise in FIG. 4. The biasing member is, for example, a metal spring. The arm 49 biased by the biasing member comes into contact with the support portion 83 and is stopped at an initial position.

A trigger valve 51 is provided at a connection portion between the body portion 18 and the handle 19. The trigger valve 51 has a plunger 52, a first body 53, a second body 54, a valve body 55, and a biasing member 69. The first body 53 and the second body 54 both have a tubular shape, and the first body 53 and the second body 54 are arranged concentrically about a center line A2. The valve body 55 is disposed across an inside of the first body 53 and an inside of the second body 54. A passage 56 is formed in the first body 53.

Further, the handle 19 has a passage 58, and the passage 58 connects the pressure accumulation chamber 20 and the inside of the first body 53. A sealing member 59 that seals between the first body 53 and the main body 11 is provided. The second body 54 has a passage 60 and a shaft hole 54A. The passage 60 is connected to the outside B1 of the main body 11. The second body 54 has a space 64 connected to the shaft hole 54A.

Sealing members 61, 62, and 63 are attached to an outer peripheral surface of the valve body 55. The valve body 55 has a shaft hole 65. The sealing member 63 hermetically seals the space 64. The plunger 52 is disposed across an inside of the shaft holes 54A and 65. Sealing members 66 and 67 are attached to an outer peripheral surface of the plunger 52. A flange 68 projecting from the outer peripheral surface of the plunger 52 is provided. The biasing member 69 is provided in the shaft hole 65. The biasing member 69 is, for example, a compression spring, and the biasing member 69 biases the plunger 52 toward the arm 49 in the direction of the center line A2.

A first ventilation passage 57 and a second ventilation passage 106 are provided. The first ventilation passage 57 connects the control chamber 27 and the passage 56. The first ventilation passage 57 is provided in the body portion 18. As shown in FIG. 4, a first valve 107 is provided in the body portion 18. The first valve 107 opens and closes the first ventilation passage 57. The first valve 107 has a columnar shape, and the first valve 107 is rotatably supported by the body portion 18 about a center line A5. A connection passage 108 that penetrates the first valve 107 in the radial direction is provided.

A second gear 109 is attached to the first valve 107. The second gear 109 is arranged concentrically with the first valve 107, and the second gear 109 and the first valve 107 can rotate integrally. The second gear 109 meshes with the first gear 105. When an operation force is applied to the mode selection member 84 and the first gear 105 is rotated, the rotational force of the first gear 105 is transmitted to the second gear 109. When the first gear 105 stops, the second gear 109 stops. The first valve 107 is rotated or stopped together with the second gear 109. When the first valve 107 is stopped, the connection passage 108 is connected to or disconnected from the first ventilation passage 57. The state where the connection passage 108 and the first ventilation passage 57 are connected is the state where the first valve 107 is open. The state where the connection passage 108 and the first ventilation passage 57 are disconnected is the state where the first valve 107 is closed.

A switching mechanism 135 is made up of the mode selection member 84, the boss portion 102, the first gear 105, and the second gear 109. The switching mechanism 135 is configured to switch the actuation and the stop of the first valve 107.

Figure 5:
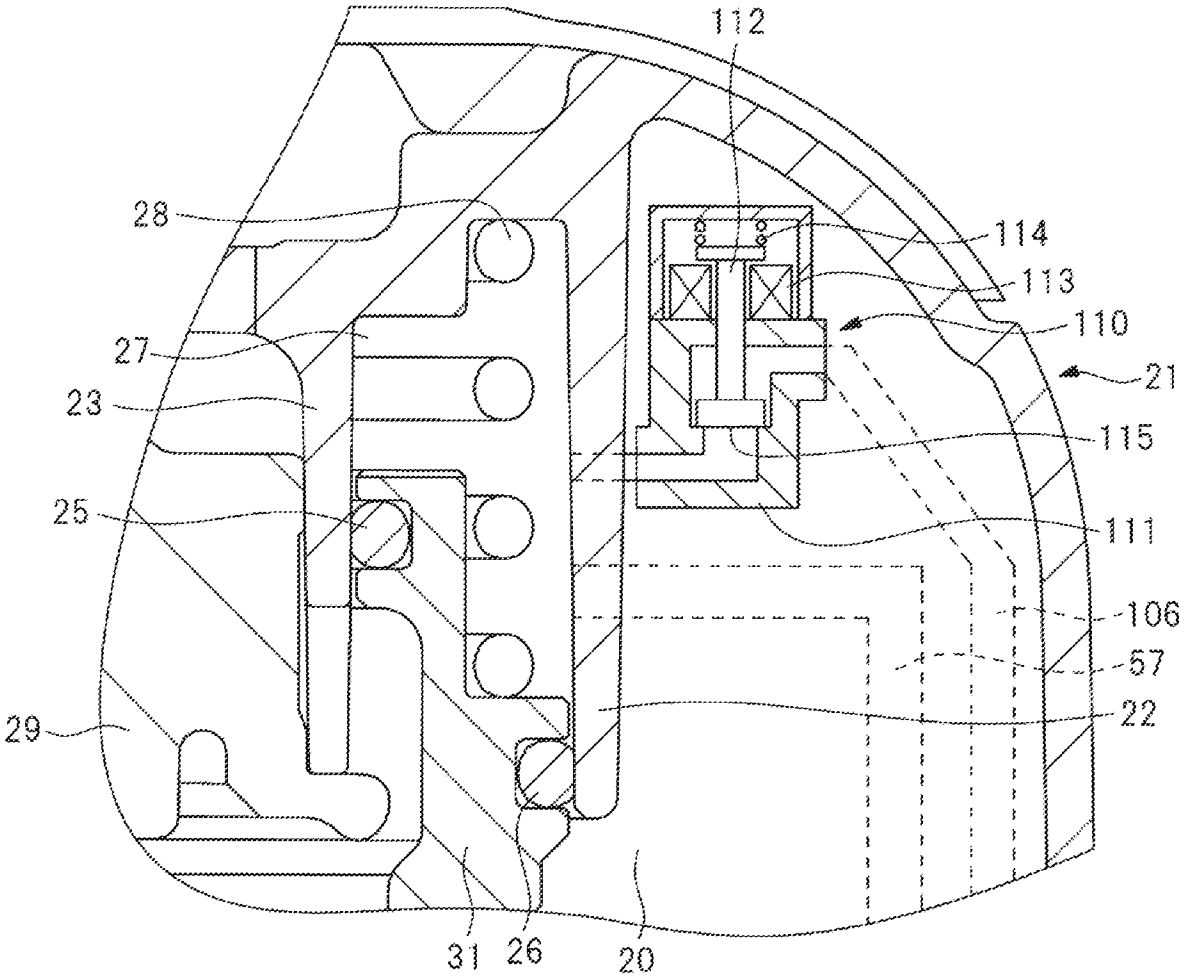
FIG. 5 is a cross-sectional view showing a part of FIG. 2.

The second ventilation passage 106 is disposed in parallel to the first ventilation passage 57. The second ventilation passage 106 is provided across the body portion 18 and the head cover 21. As shown in FIG. 5, a solenoid valve 110 is provided in the head cover 21. The solenoid valve 110 has a valve body 111, a plunger 112, a coil 113, and a biasing member 114. The valve body 111 has a port 115 and the plunger 112 can be actuated. The plunger 112 is made of a magnetic material. The biasing member 114 is, for example, a metal compression spring. When the power supply to the solenoid valve 110 is stopped, the plunger 112 biased by the force of the biasing member 114 comes into contact with the valve body 111 and is stopped there, and the plunger 112 closes the port 115. Namely, the solenoid valve 110 closes the second ventilation passage 106. When power is supplied to the solenoid valve 110, the plunger 112 is actuated by the magnetic attraction force against the force of the biasing member 114, and the plunger 112 opens the port 115. Namely, the solenoid valve 110 opens the second ventilation passage 106.

The ejection portion 15 shown in FIG. 1 is made of, for example, metal or non-ferrous metal. The ejection portion 15 has a tubular portion 70 and a flange 71 connected to an outer peripheral surface of the tubular portion 70. The flange 71 is fixed to the body portion 18 by a fixing element. The tubular portion 70 has an ejection path 72. The center line A1 is located in the ejection path 72, and the driver blade 35 is movable in the ejection path 72 in the direction of the center line A1.

The magazine 17 is fixed to the ejection portion 15. The magazine 17 stores nails 73. The magazine 17 has a feeder 74, and the feeder 74 sends the nails 73 in the magazine 17 to the ejection path 72.

A transmission member 75 connected so as to be able to transmit power to the push lever 16 is provided. As shown in FIG. 4, the transmission member 75 is supported by the holder 48. A part of the transmission member 75 is disposed in the guide hole 82. The transmission member 75 is movable with respect to the holder 48 in the direction of a center line A3. The center line A3 is parallel to the center line A2. When the transmission member 75 comes into contact with the arm 49, the actuation force of the push lever 16 is transmitted to the arm 49. When the transmission member 75 is separated from the arm 49, the actuation force of the push lever 16 is not transmitted to the arm 49. The transmission member 75 is biased by a biasing member 76 in the direction away from the arm 49. The biasing member 76 is, for example, a metal spring.

Figure 6:
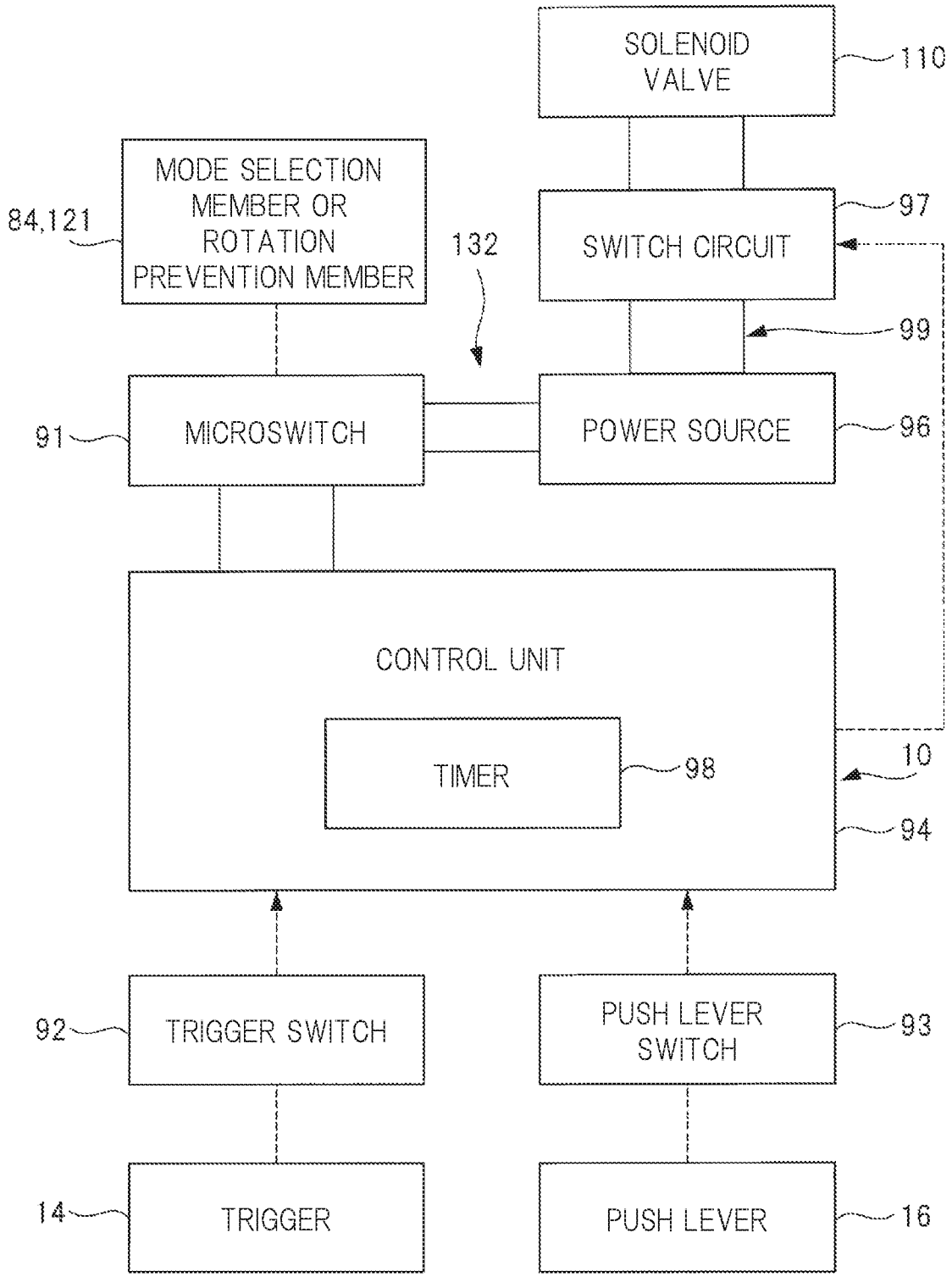
FIG. 6 is a block diagram showing a control system of the driver.

FIG. 6 is a block diagram showing a control system of the driver 10. The driver 10 includes a trigger switch 92, a push lever switch 93, a microswitch 91, a control unit 94, a power source 96, and a switch circuit 97. The power source 96 is connected to the solenoid valve via an electric circuit 99. An electric circuit 132 is provided between the power source 96 and the control unit 94, and the microswitch 91 connects and disconnects the electric circuit 132. When the mode selection member 84 is located at the first operation position, the microswitch 91 disconnects the electric circuit 132. When the mode selection member 84 is located at the second operation position, the microswitch 91 connects the electric circuit 132.

The power source 96 is an element that applies a voltage to the control unit 94 and the solenoid valve 110, and a secondary battery that can be charged and discharged can be used for the power source 96. The power source 96 can be attached to, for example, the handle 19 or the magazine 17.

The control unit 94 is a microcomputer including an input interface, an output interface, a storage unit, an arithmetic processing unit, and a timer 98. The control unit 94 is activated when the electric circuit 132 is connected and a voltage is applied from the power source 96. When the electric circuit 132 is disconnected, the control unit 94 is stopped because no voltage is applied from the power source 96.

The trigger switch 92 outputs different signals depending on whether the operation force is applied to the trigger 14 or the operation force to the trigger 14 is released. The push lever switch 93 outputs different signals depending on whether the push lever 16 is pressed to a workpiece 77 or is separated from it. The trigger switch 92 and the push lever switch 93 may be either contact switches or non-contact switches. The signals from the trigger switch 92 and the push lever switch 93 are input to the control unit 94.

The control unit 94 processes the signal of the trigger switch 92 and detects whether the operation force is applied to the trigger 14 or the operation force to the trigger 14 is released. The control unit 94 processes the signal of the push lever switch 93 and detects whether the push lever 16 is in contact with the workpiece 77 or the push lever 16 is separated from the workpiece 77.

The switch circuit 97 is provided in the electric circuit 99. The switch circuit 97 includes, for example, a plurality of field effect transistors. The control unit 94 controls the switch circuit 97 to connect or disconnect the electric circuit 99.

Next, an example in which the nail 73 shown in FIG. 1 is driven into the workpiece 77 with use of the driver 10 will be described. In the state where the worker releases the operation force to the trigger 14 and the push lever, the worker operates the mode selection member 84 to select the first mode or the second mode. In accordance with the operation position of the mode selection member 84, the position of the support shaft 47 with respect to the transmission member 75 changes. When the operation position of the mode selection member 84 changes, the position of the support shaft 47 with respect to the transmission member 75 changes in the direction intersecting the center line A3. Therefore, the position of the tip of the arm 49 with respect to the transmission member 75 changes.

(Example in which Worker Selects First Mode)

An example in which the worker operates the mode selection member 84 to select the first mode will be described with reference to FIG. 4 and FIG. 5. When the first mode is selected, the microswitch 91 disconnects the electric circuit 132, and thus the control unit 94 is stopped. When the operation force to the trigger 14 is released and the push lever 16 is separated from the workpiece 77 in the state where the first mode is selected, the trigger valve 51, the head valve 31, and the striking portion 13 are in the following initial states.

The trigger 14 is in contact with the support portion 83 and is stopped at the initial position. Further, the arm 49 is in contact with the support portion 83 and is stopped at the initial position. The tip of the arm 49 is within the actuation range of the transmission member 75. The transmission member 75 is stopped at the initial position separated from the arm 49. In addition, the arm 49 is separated from the plunger 52. Namely, no actuation force is applied from the arm 49 to the plunger 52.

The flange 68 is pressed to the second body 54 by the biasing member 69. The valve body 55 is biased by the biasing force of the biasing member 69 in the direction away from the arm 49, and the sealing member 62 is pressed to the first body 53, so that the valve body 55 is stopped at the initial position.

The sealing member 62 disconnects the passage 56 and the passage 60. The sealing member 61 is separated from the first body 53, and the pressure accumulation chamber 20 is connected to the control chamber 27 via the passage 58, the passage 56, and the first ventilation passage 57. The sealing member 66 is separated from the valve body 55, and the pressure accumulation chamber 20 is connected to the space 64 via the passage 58 and the shaft hole 65. The sealing member 67 seals the shaft hole 54A to disconnect the space 64 and the outside B1.

On the other hand, when the worker selects the first mode, the first valve 107 is in the state of opening the first ventilation passage 57. The compressed air of the pressure accumulation chamber is supplied to the control chamber 27 through the first ventilation passage 57. In addition, when the first mode is selected, the control unit 94 is stopped, so that no power is supplied to the solenoid valve 110. Therefore, the solenoid valve 110 closes the second ventilation passage 106 as shown in FIG. 5.

Figure 2:
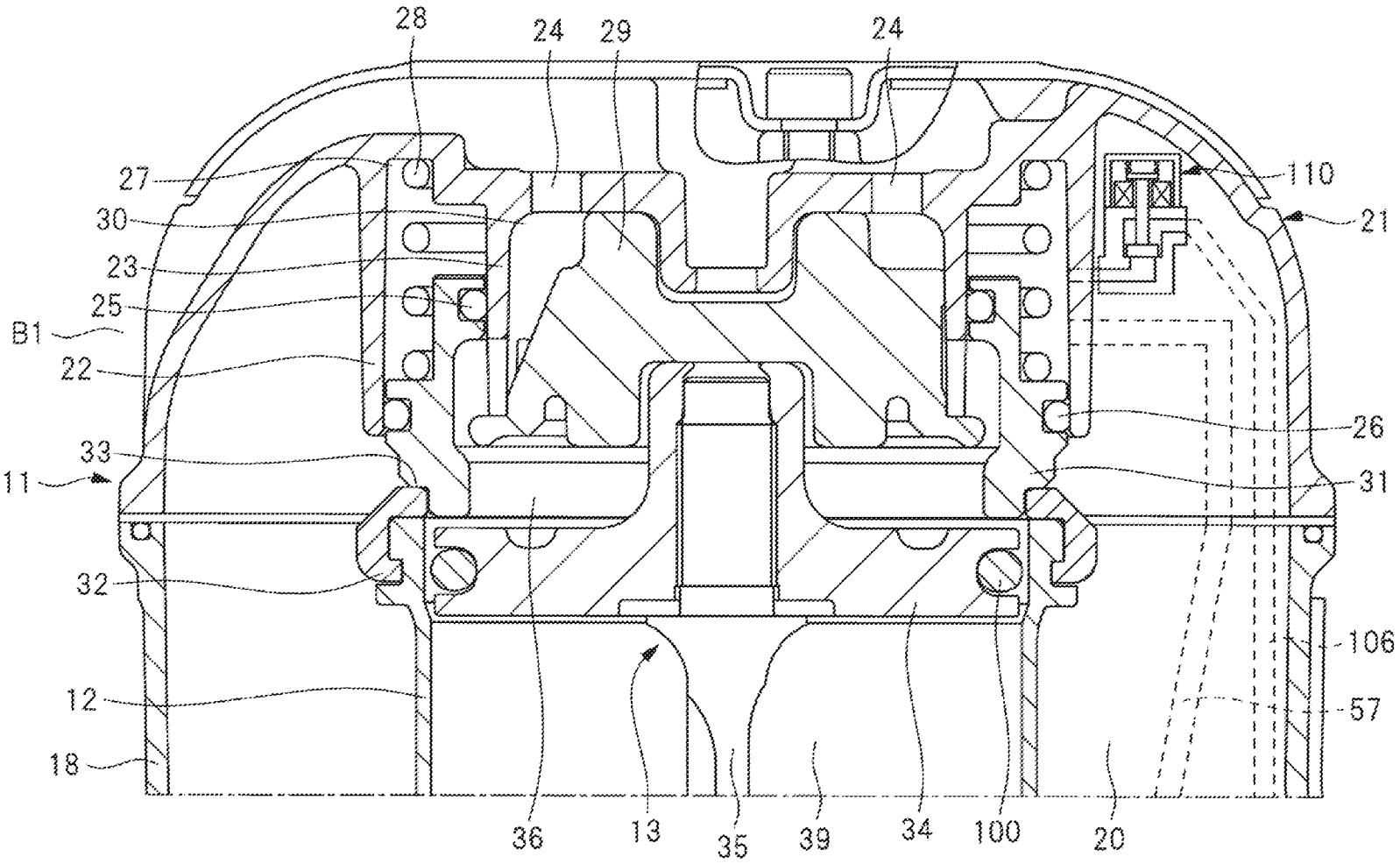
FIG. 2 is a cross-sectional view showing an internal structure of a head cover of the driver.

As shown in FIG. 2, the head valve 31 is pressed to the valve seat 32 by the biasing force of the biasing member 28 and the pressure of the control chamber 27. The head valve 31 closes the port 33. Also, the inner peripheral surface of the head valve 31 is separated from the outer peripheral end of the stopper 29. The upper piston chamber 36 is connected to the outside B1 via the passage 30 and the exhaust passage 24. Therefore, the pressure of the upper piston chamber 36 is equal to the atmospheric pressure and is lower than the pressure of the lower piston chamber 39. Accordingly, the piston 34 is stopped while being pressed to the stopper 29 by the pressure of the lower piston chamber 39. As described above, the striking portion 13 is stopped at the top dead center shown in FIG. 1 and FIG. 2.

When the worker presses the push lever 16 to the workpiece 77 in the state where the worker selects the first mode and does not apply the operation force to the trigger 14, the control unit 94 detects that the operation force is applied to the push lever 16. Also, the actuation force of the push lever 16 is transmitted to the transmission member 75. The transmission member 75 is actuated toward the trigger valve 51 from the initial position against the biasing force of the biasing member 76. Then, the transmission member 75 projects from the support portion 83, and the actuation force of the transmission member 75 is transmitted to the arm 49. The arm 49 is actuated clockwise about the support shaft 50, and when the transmission member 75 is stopped at the actuated position, the arm 49 is also stopped at the intermediate position. In this state, the actuation force of the arm 49 is not transmitted to the plunger 52, and the plunger 52 is stopped at the initial position.

When the worker maintains the state of pressing the push lever 16 to the workpiece 77 and applies an operation force to the trigger 14, the trigger 14 is actuated counterclockwise about the support shaft 47. Then, the arm 49 is actuated with the transmission member 75 as a fulcrum, and the actuation force of the arm 49 is transmitted to the plunger 52. The plunger 52 is actuated from the initial position against the biasing force of the biasing member 69. When the trigger 14 comes into contact with the main body 11 and is stopped at the actuated position, the arm 49 is stopped at the actuated position and the plunger 52 is stopped at the actuated position.

When the plunger 52 is stopped at the actuated position, the sealing member 66 seals the shaft hole 65. The sealing member 67 moves to the space 64, and the space 64 and the outside B1 are connected via the shaft hole 54A. Therefore, the valve body 55 is actuated by the pressure of the compressed air of the pressure accumulation chamber 20 against the force of the biasing member 69, and the sealing member 61 disconnects the pressure accumulation chamber 20 and the passage 56. Also, the sealing member 62 separates from the first body 53, and the passage 56 and the passage 60 are connected. Therefore, the compressed air of the control chamber 27 is discharged to the outside B1 through the first ventilation passage 57, the passage 56, and the passage 60, and the pressure of the control chamber 27 becomes equal to the atmospheric pressure.

When the pressure of the control chamber 27 becomes equal to the atmospheric pressure, the head valve 31 is actuated by the pressure of the pressure accumulation chamber 20 against the biasing force of the biasing member 28, and the head valve 31 is separated from the valve seat 32 and is stopped there. Thus, the port 33 is opened, and the pressure accumulation chamber 20 is connected to the upper piston chamber 36 via the port 33. Further, the head valve 31 comes into contact with the stopper 29, and the head valve 31 disconnects the upper piston chamber 36 and the exhaust passage 24. Then, the compressed air of the pressure accumulation chamber 20 is supplied to the upper piston chamber 36, and the pressure of the upper piston chamber 36 rises. When the pressure of the upper piston chamber 36 becomes higher than the pressure of the lower piston chamber 39, the striking portion 13 is actuated from the top dead center to the bottom dead center in the direction of the center line A1, and the driver blade 35 strikes the nail 73 in the ejection path 72. The struck nail 73 is driven into the workpiece 77.

After the striking portion 13 drives the nail 73 into the workpiece 77, the piston 34 collides with the bumper 37 as shown in FIG. 3, and the bumper 37 absorbs a part of the kinetic energy of the striking portion 13. The position of the striking portion 13 at the time when the piston 34 collides with the bumper 37 is the bottom dead center. Also, the check valve 44 opens the passage 41 while the striking portion 13 is being actuated from the top dead center to the bottom dead center, and the compressed air of the lower piston chamber 39 flows into the return air chamber 43 via the passage 41.

When the worker separates the push lever 16 from the workpiece 77, the transmission member 75 is actuated by the biasing force of the biasing member 76 and is stopped at the initial position. Also, when the worker releases the operation force to the trigger 14, the trigger 14 returns from the actuated position to the initial position, and the arm 49 returns from the actuated position to the initial position and is stopped there by the biasing force of the biasing member 81.

Further, the plunger 52 returns from the actuated position to the initial position, and the head valve 31 returns to the initial state to close the port 33. Then, the pressure of the upper piston chamber 36 becomes equal to the atmospheric pressure, and the piston 34 is actuated from the bottom dead center toward the top dead center by the pressure of the lower piston chamber 39. Further, the compressed air of the return air chamber 43 flows into the lower piston chamber 39 through the passage 42, and the striking portion 13 returns to the top dead center and is stopped there.

Furthermore, also in the case where the worker releases the operation force to the trigger 14, slides the push lever 16 on the workpiece 77 and stops it, and then applies the operation force to the trigger 14 again while maintaining the state of pressing the push lever 16 to the workpiece 77, the striking portion 13 is actuated in the direction of driving the nail 73 according to the same principle as described above.

On the other hand, even when the worker separates the push lever 16 from the workpiece 77 and presses the push lever 16 to the workpiece 77 again while maintaining the state in which the worker applies the operation force to the trigger 14, the actuation force of the transmission member 75 is not transmitted to the arm 49. Namely, the striking portion 13 is held in a state of being stopped at the top dead center.

(Example in which Worker Selects Second Mode)

Figure 7:
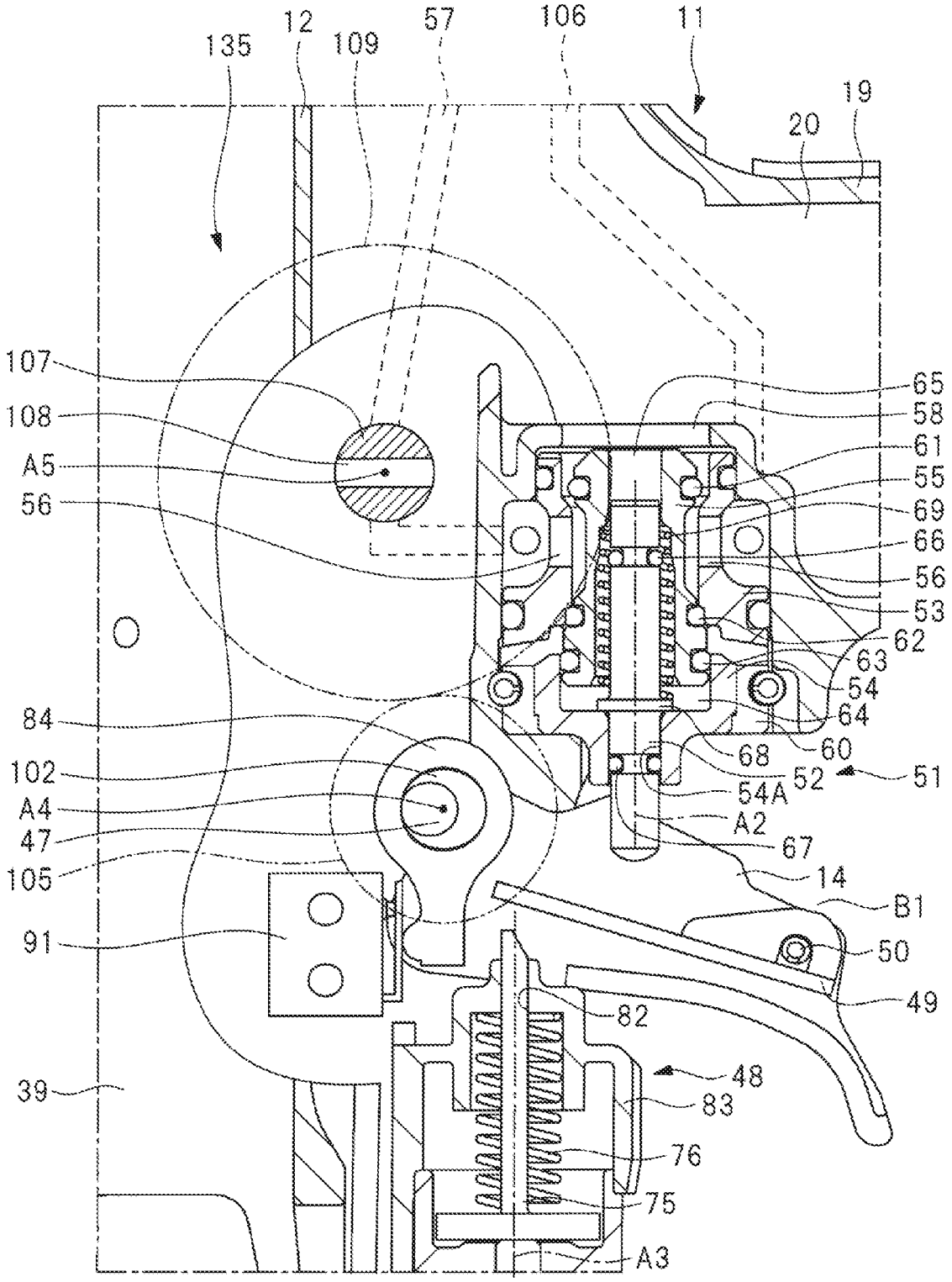
FIG. 7 is a cross-sectional view showing a state in which a second mode is selected in the first specific example of the switching mechanism.

When the worker operates the mode selection member 84 to select the second mode, the microswitch 91 connects the electric circuit 132 and a voltage is applied from the power source 96 to the control unit 94, so that the control unit 94 is activated. Further, as shown in FIG. 7, the first valve 107 closes the first ventilation passage 57. When the worker applies an operation force to the trigger 14 in the state where the worker separates the push lever 16 from the workpiece 77, the trigger 14 is actuated counterclockwise from the initial position against the biasing force of the biasing member 80 and is stopped at the actuated position. Further, the timer 98 starts measuring the elapsed time from when the operation force is applied to the trigger 14. Further, the arm 49 is actuated with the support portion 83 as a fulcrum. However, since the push lever 16 is not pressed to the workpiece 77, the actuation force of the arm 49 is not transmitted to the plunger 52, and the plunger 52 is stopped at the initial position.

When the push lever 16 is pressed to the workpiece 77 in the state where the operation force is applied to the trigger 14, the plunger 52 is actuated from the initial position and is stopped at the actuated position. Namely, the trigger valve 51 is in the actuated state in which the pressure accumulation chamber 20 and the passage 56 are disconnected and the passage 56 is connected to the outside B1 via the passage 60.

Here, the control unit 94 determines whether the elapsed time from when the operation force is applied to the trigger 14 to when the operation force is applied to the push lever 16 is within a predetermined time or exceeds the predetermined time. The predetermined time is, for example, 3 seconds, and the control unit 94 stores the predetermined time in advance.

When the control unit 94 determines that the elapsed time from when the operation force is applied to the trigger 14 to when the operation force is applied to the push lever 16 is within the predetermined time, the control unit 94 controls the switch circuit 97 to supply power to the solenoid valve 110, thereby controlling the solenoid valve 110 to be in the state of opening the second ventilation passage 106.

Here, as the control by the control unit 94 to supply power to the solenoid valve 110, the first control or the second control can be selected. The first control is to start the power supply to the solenoid valve 110 when the operation force is applied to the trigger 14 and constantly supply the power to the solenoid valve 110 within a predetermined time. The second control is not to supply power to the solenoid valve 110 when the operation force is applied to the trigger 14 and supply power to the solenoid valve 110 when the operation force is applied to the push lever 16 to press it to the workpiece 77 within a predetermined time.

In this manner, when the push lever 16 is pressed to the workpiece 77 in the state where the second mode is selected and the operation force is applied to the trigger 14, the solenoid valve 110 is in the state of opening the second ventilation passage 106. Therefore, the compressed air of the control chamber 27 is discharged to the outside B1 via the second ventilation passage 106, the passage 56, and the passage 60, and the striking portion 13 is actuated in the direction of striking the nail 73 from the top dead center. Note that the timer 98 resets the measured elapsed time and newly starts measuring the elapsed time.

Thereafter, in the state where the second mode is selected and the operation force is applied to the trigger 14, the worker can drive the nail 73 into the workpiece 77 by performing the operation of pressing the push lever 16 to the workpiece 77 and separating the push lever 16 from the workpiece 77.

On the other hand, when the elapsed time from when the operation force is applied to the trigger 14 exceeds the predetermined time, the control unit 94 controls the switch circuit 97 to stop the power supply to the solenoid valve 110. Namely, the control unit 94 controls the solenoid valve 110 to be in the state of closing the second ventilation passage 106.

Here, as the control by the control unit 94 to stop the power supply to the solenoid valve 110, the third control or the fourth control can be selected. The third control is to start the power supply to the solenoid valve 110 when an operation force is applied to the trigger 14 and stop the power supply to the solenoid valve 110 when a predetermined time has elapsed. The fourth control is not to supply power to the solenoid valve 110 when the operation force is applied to the trigger 14 and not supply power to the solenoid valve 110 even after a predetermined time has elapsed.

Therefore, when the push lever 16 is pressed to the workpiece 77 after a predetermined time has elapsed from when the second mode is selected and the operation force is applied to the trigger 14, the solenoid valve 110 is in the state of closing the second ventilation passage 106. Accordingly, the compressed air of the control chamber 27 is not discharged to the outside B1 via the second ventilation passage 106. Also, when the second mode is selected, the first valve 107 is in the state of closing the first ventilation passage 57. Thus, the striking portion 13 is stopped at the top dead center, and the striking portion 13 does not strike the nail 73.

Note that, when the worker separates the push lever 16 from the workpiece 77 and releases the operation force to the trigger 14, the timer 98 resets the measured elapsed time.

As described above, in the driver 10, the first ventilation passage 57 through which the compressed air is discharged from the control chamber 27 to the outside B1 when the first mode is selected and the second ventilation passage 106 through which the compressed air is discharged from the control chamber 27 to the outside B1 when the second mode is selected are separately provided. Therefore, if the solenoid valve 110 is not actuated normally for some reason and the second ventilation passage 106 is in a closed state, the first valve 107 is in the state of opening the first ventilation passage 57 when the mode selection member 84 is operated to select the first mode. As a result, in the driver 10, the striking portion 13 is actuated in the first mode and can strike the nail 73.

Further, when the worker operates the mode selection member 84 to select the second mode and the worker presses the push lever 16 to the workpiece 77 and then applies an operation force to the trigger 14, the trigger valve 51 becomes the actuated state from the initial state. Therefore, the compressed air of the control chamber 27 is discharged to the outside B1 via the second ventilation passage 106, the passage 56, and the passage 60, and the striking portion 13 strikes the nail 73. Note that, when the worker operates the mode selection member 84 to select the second mode, the timer 98 does not start measuring the elapsed time even if the worker presses the push lever 16 to the workpiece 77 and then applies an operation force to the trigger 14.

As described above, the first ventilation passage 57 through which compressed air is discharged when the first mode is selected and the second ventilation passage 106 through which compressed air is discharged when the second mode is selected are provided separately. This is the structure in which the first ventilation passage 57 can be mechanically opened and closed by transmitting the actuation force of the mode selection member 84 to the first valve 107 to actuate the first valve 107. Therefore, even in the state where the striking portion 13 cannot be actuated in the direction of striking the nail 73 like the case where the power cannot be supplied to the solenoid valve 110 though the power source 96 has power in the state where the second mode is selected or the case where the power supply 96 has no power, the striking portion 13 can be actuated in the direction of striking the nail 73 by selecting the first mode.

Furthermore, when the first mode is selected, no voltage is applied from the power source 96 to the control unit 94, and the control unit 94 is stopped. In addition, when the second mode is selected, a voltage is applied from the power source 96 to the control unit 94, and the control unit 94 is activated. Therefore, the amount of consumed power of the power source 96 can be reduced as much as possible.

A second specific example of the switching mechanism that can be provided in the driver 10 of FIG. 1 will be described with reference to FIG. 8 and FIG. 9. The trigger 14 is attached to a support shaft 117, and the main body 11 rotatably supports the support shaft 117 about a center line A6. The support shaft 117 does not move in the direction intersecting the center line A6. A first gear 118 is provided on the support shaft 117. The first valve 107 is attached to a valve shaft 119. The valve shaft 119 and the first valve 107 are rotatably supported by the body portion 18 about the center line A5. The valve shaft 119 is biased clockwise by a biasing member 120 in FIG. 8. The biasing member 120 is, for example, a metal torsion spring. A rotation prevention member 121 is attached to the valve shaft 119. An engagement portion 122 protruding from an outer surface of the rotation prevention member 121 is provided. A stopper 131 is provided on the body portion 18, and the rotation prevention member 121 and the valve shaft 119 are stopped when the engagement portion 122 is in contact with the stopper 131.

A fixing member 123 is attached to the valve shaft 119, and a clutch 124 is also attached thereto. The clutch 124 is fixed to the valve shaft 119. The clutch 124 has an engagement portion 128 disposed along the rotation direction of the valve shaft 119. A second gear 125 is attached to the valve shaft 119. The second gear 125 is movable in the direction of the center line A5 with respect to the valve shaft 119 and is rotatable with respect to the valve shaft 119. Further, a third gear 126 is provided, and the third gear 126 meshes with the first gear 118 and the second gear 125.

Further, a biasing member 127 is provided between the fixing member 123 and the second gear 125. The biasing member 127 biases the second gear 125 toward the clutch 124 in the direction of the center line A5. The biasing member 127 is, for example, a metal compression spring. The second gear 125 is biased by the biasing member 127 while meshing with the third gear 126. The second gear 125 has an engagement portion 129 disposed along the rotation direction. The engagement portion 128 of the second gear 125 and the engagement portion 129 of the clutch 124 can be engaged with and released from each other. Namely, the second gear 125 and the clutch 124 can be engaged with and released from each other.

Furthermore, a push lever arm 130 is provided. The push lever arm 130 is coupled to the push lever 16, and the push lever arm 130 can be actuated together with the push lever 16 in the direction of the center line A3. The tip of the push lever arm 130 can be engaged with and released from the engagement portion 122. The support shaft 117, the first gear 118, the second gear 125, the third gear 126, the clutch 124, the valve shaft 119, the rotation prevention member 121, and the push lever arm 130 constitute a switching mechanism 136. The switching mechanism 136 is configured to switch the actuation and the stop of the first valve 107. The switching mechanism 136 can be provided in the driver 10 of FIG. 1.

Figure 8:
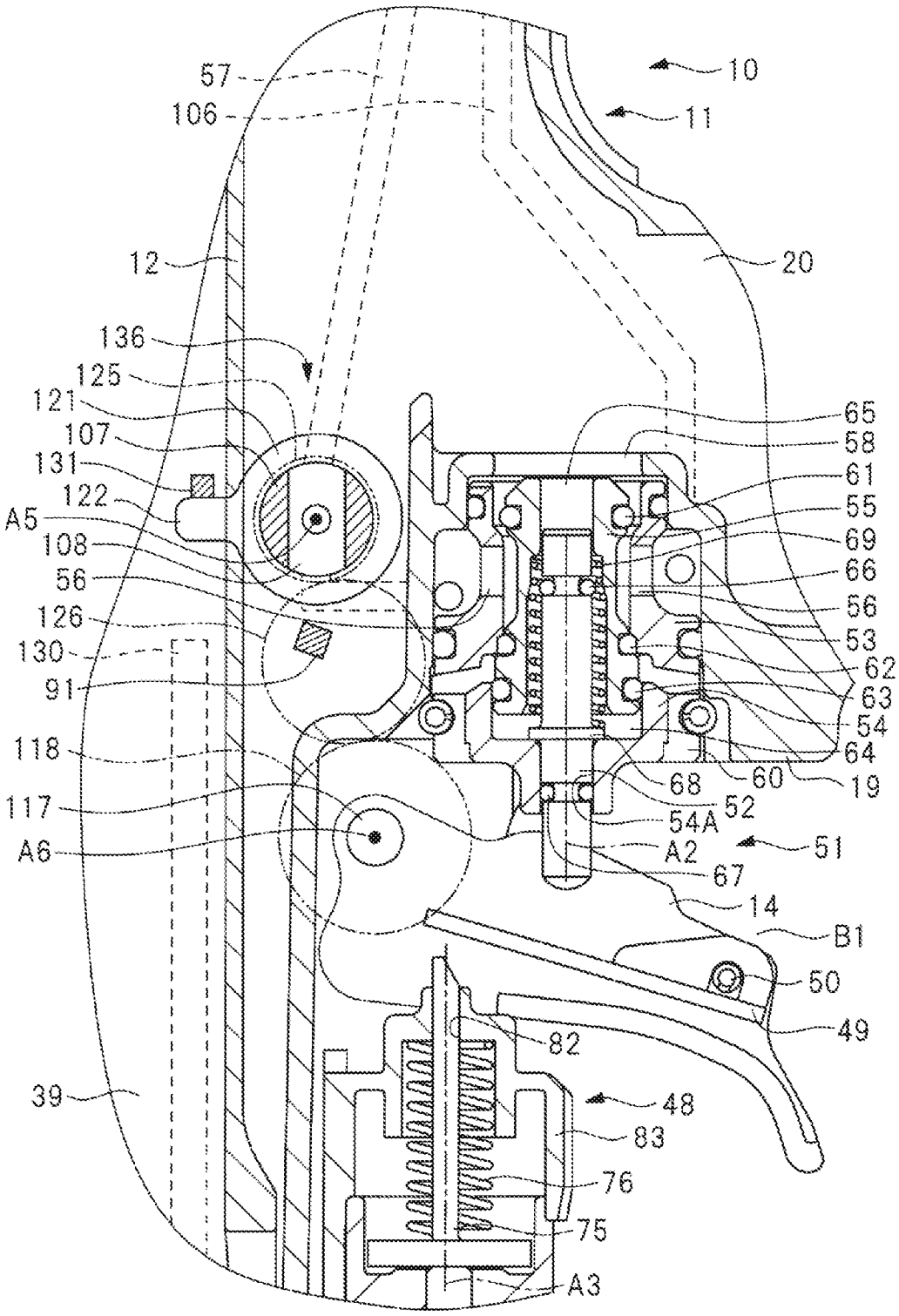
FIG. 8 is a cross-sectional view showing a second specific example of a switching mechanism provided in a driver.
Figure 9:
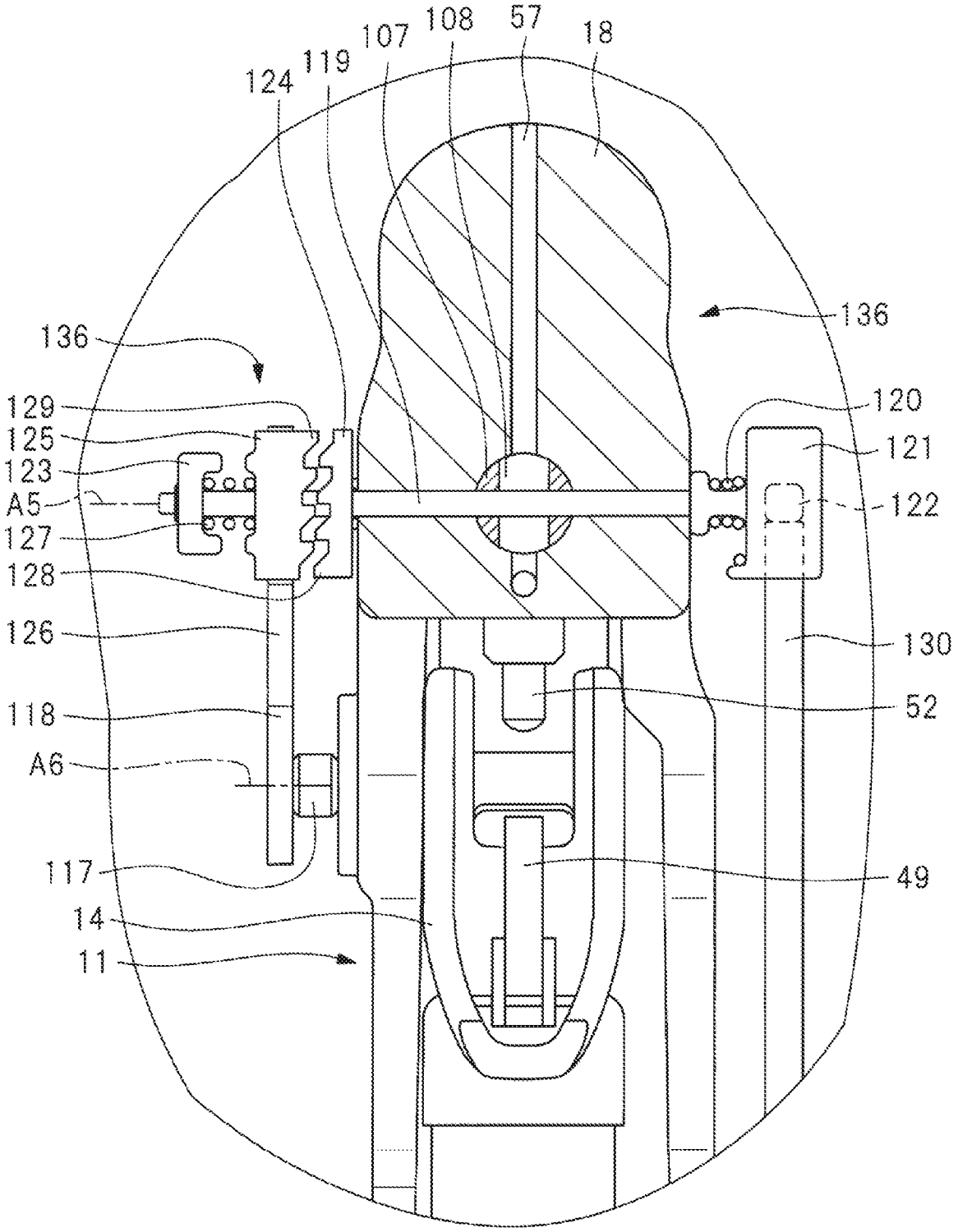
FIG. 9 is a cross-sectional view showing a state in which a second gear and a clutch are released from each other in the second specific example of the switching mechanism.

The driver 10 shown in FIG. 8 can use the control system shown in FIG. 6. In this case, the mode selection member 84 is not provided. The microswitch 91 is disposed on the outer peripheral side of the rotation prevention member 121 as shown in FIG. 8. When the rotation prevention member 121 rotates, the engagement portion 12 comes into contact with or separates from the microswitch 91. The microswitch 91 connects or disconnects the electric circuit 132 depending on the position of the rotation prevention member 121 in the rotation direction.

When the worker does not apply an operation force to any of the trigger 14 and the push lever 16, the engagement portion 122 comes into contact with the stopper 131 and the rotation prevention member 121 and the first valve 107 are stopped as shown in FIG. 8. The first valve 107 is in the state of opening the first ventilation passage 57. Further, the push lever arm 130 is stopped at the initial position shown in FIG. 8. The push lever arm 130 stopped at the initial position is separated from the engagement portion 122 and is located outside the actuation range of the engagement portion 122. Further, the second gear 125 and the clutch 124 are engaged. Also, when the engagement portion 122 is in contact with the stopper 131, the engagement portion 122 is separated from the microswitch 91, and the control unit 94 is stopped. Therefore, power is not supplied from the power source 96 to the solenoid valve 110, and the solenoid valve 110 closes the second ventilation passage 106.

(Example in which Worker Selects First Mode)

Figure 10:
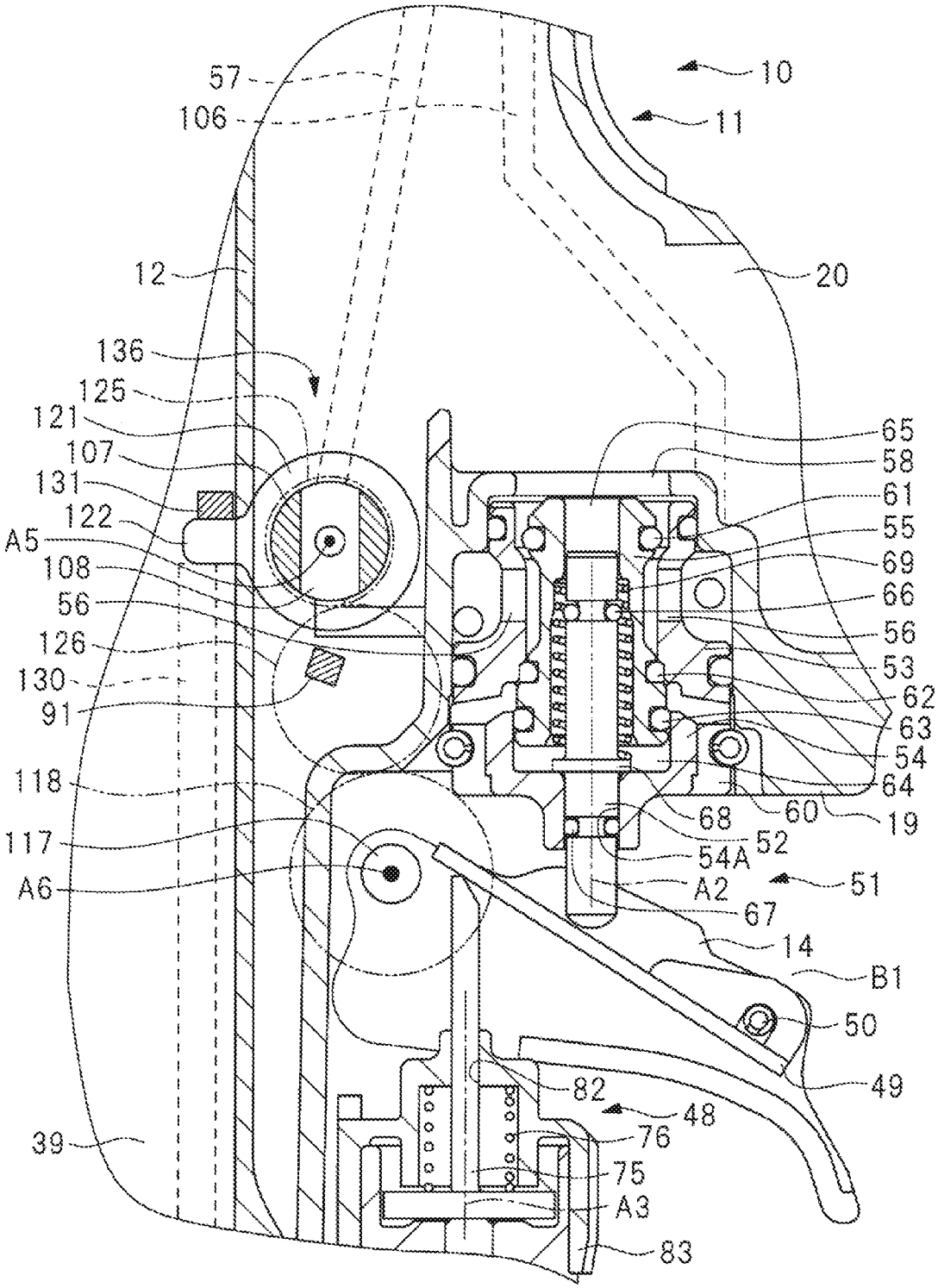
FIG. 10 is a cross-sectional view showing a state in which the first mode is selected in the second specific example of the switching mechanism.

The first mode is a usage mode of the driver 10 in which the worker presses the push lever 16 to the workpiece 77 and then applies an operation force to the trigger 14. When the worker presses the push lever 16 to the workpiece 77, the push lever arm 130 engages with the engagement portion 122 and is stopped as shown in FIG. 9 and FIG. 10. Further, the transmission member 75 moves from the initial position to the actuated position, and the transmission member 75 rotates the arm 49 and is stopped.

Figure 11:
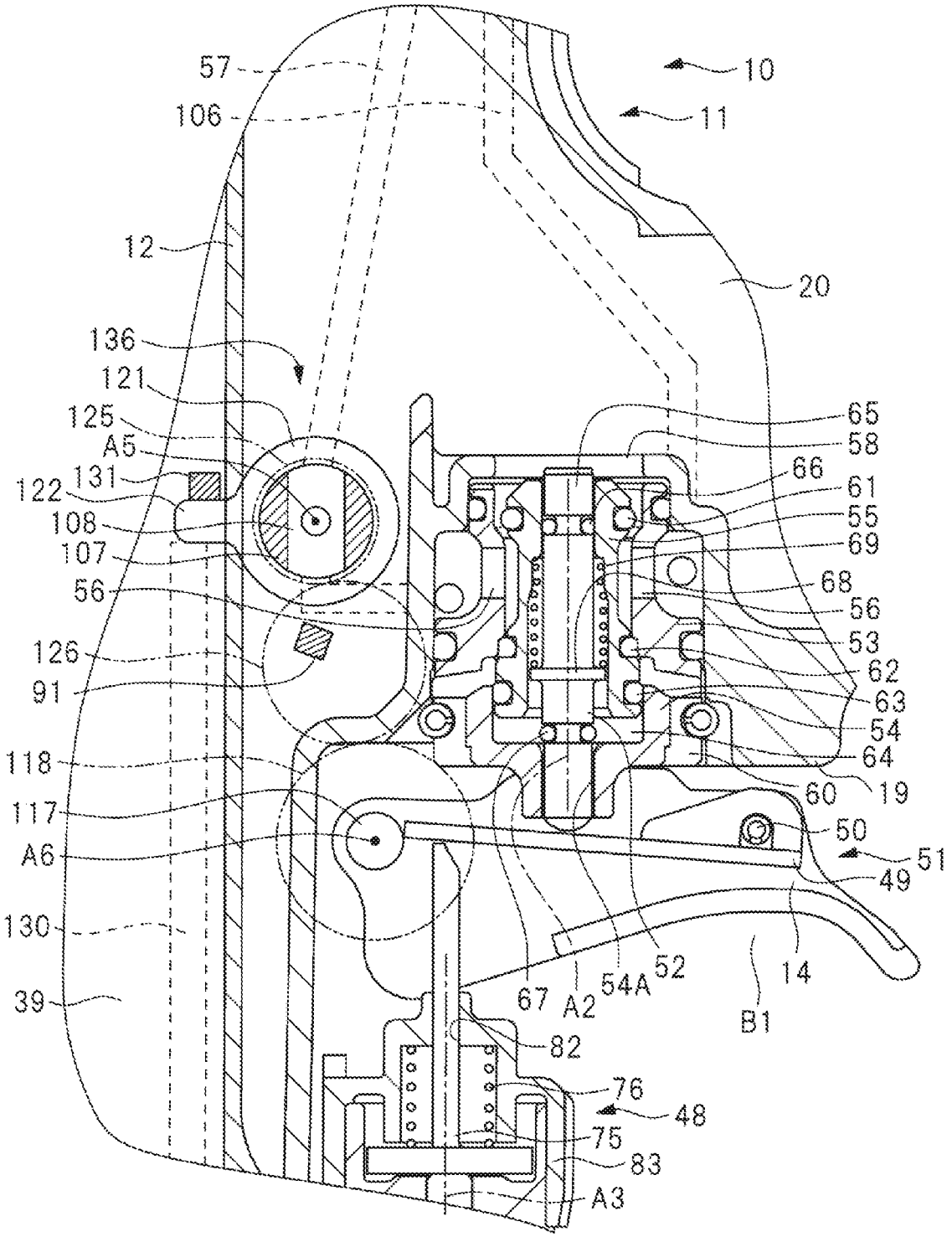
FIG. 11 is a cross-sectional view showing a state in which the first mode is selected and then an operation force is applied to a trigger in the second specific example of the switching mechanism.

Then, when the worker applies an operation force to the trigger 14, the trigger 14 rotates counterclockwise as shown in FIG. 11, and the support shaft 117 rotates counterclockwise. When the rotational force of the support shaft 117 is transmitted to the third gear 126, the third gear 126 rotates clockwise, and the second gear 125 receives the counterclockwise rotational force.

When the counterclockwise rotational force is transmitted to the second gear 125 in the state where the push lever arm 130 is engaged with the engagement portion 122 of the rotation prevention member 121 and the rotation of the valve shaft 119 is blocked, the engagement reaction force between the engagement portion 129 and the engagement portion 128 causes the second gear 125 to move in the direction away from the clutch 124 against the biasing force of the biasing member 127, and the engagement portion 129 and the engagement portion 128 are released. Therefore, the valve shaft 119 maintains the stopped state, and the first valve 107 is in the state of opening the first ventilation passage 57.

Further, when an operation force is applied to the trigger 14 and the trigger valve 51 is switched from the initial state to the actuated state, the compressed air of the control chamber 27 is discharged to the outside via the first ventilation passage 57, the passage 56, and the passage 60. Therefore, the striking portion 13 is actuated from the top dead center toward the bottom dead center, and the striking portion 13 strikes the nail 73.

Further, when the worker releases the operation force to the trigger 14 and separates the push lever 16 from the workpiece 77, the push lever arm 130 is separated from the engagement portion 122 and is stopped at the initial position. Also, the first gear 118 rotates clockwise, the third gear 126 rotates counterclockwise, the second gear 125 rotates clockwise, the engagement portion 129 and the engagement portion 128 are engaged, and the second gear 125 is stopped.

(Example in which Worker Selects Second Mode)

Figure 12:
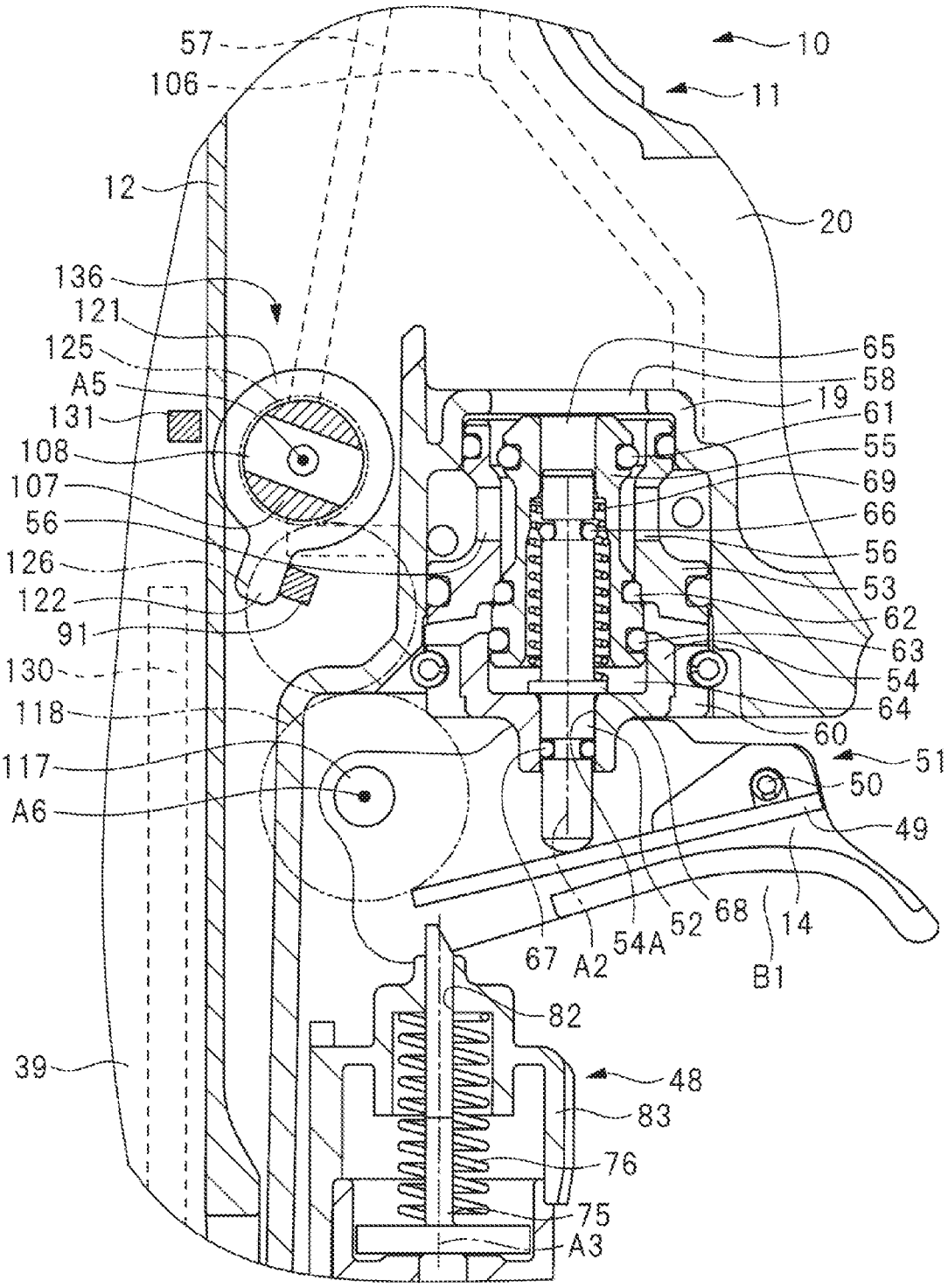
FIG. 12 is a cross-sectional view showing a state in which the second mode is selected in the second specific example of the switching mechanism.
Figure 14:
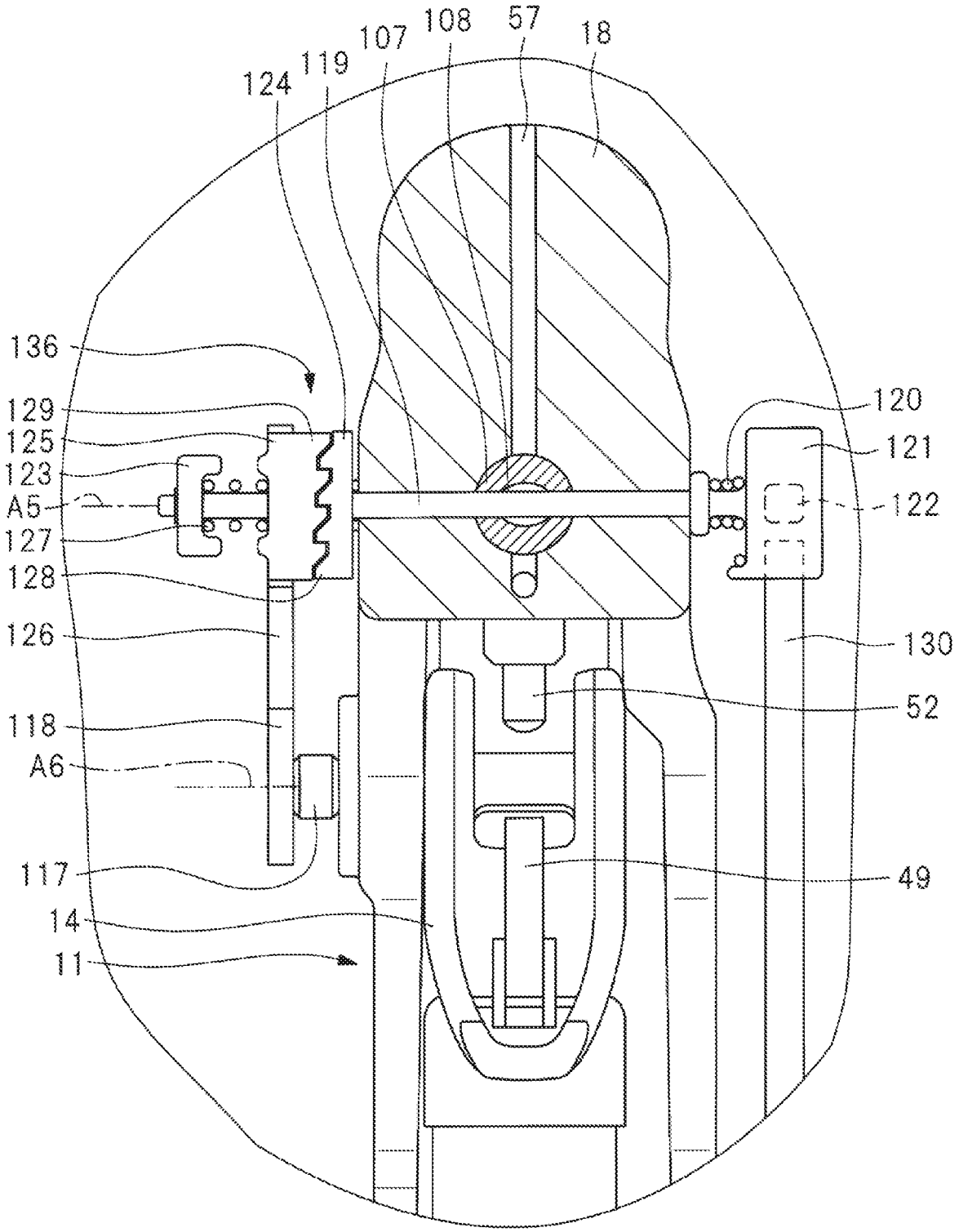
FIG. 14 is a cross-sectional view showing a state in which the second gear and the clutch are engaged with each other in the second specific example of the switching mechanism.

The second mode is a usage mode of the driver 10 in which the worker applies an operation force to the trigger 14 and then presses the push lever 16 to the workpiece 77. When the worker applies an operation force to the trigger 14 as shown in FIG. 12 in the state where the push lever 16 is separated from the workpiece 77, the operation force causes the first gear 118 to rotate counterclockwise, the third gear 126 rotates clockwise, and the second gear 125 rotates counterclockwise. Since the push lever arm 130 is located outside the actuation range of the engagement portion 122, the second gear 125 does not move in the direction of the center line A5 as shown in FIG. 14, and the state where the engagement portion 129 and the engagement portion 128 are engaged is maintained. Therefore, the rotational force of the second gear 125 is transmitted to the valve shaft 119 via the clutch 124. The valve shaft 119 rotates against the force of the biasing member 120, and the first valve 107 closes the first ventilation passage 57.

In addition, the second gear 125 rotates counterclockwise as shown in FIGS. 8 to 12, so that the engagement portion 122 comes into contact with the microswitch 91. The microswitch 91 connects the electric circuit 132, a voltage is applied from the power source 96 to the control unit 94, the control unit 94 is activated, and the timer 98 starts measuring the elapsed time from when the operation force is applied to the trigger 14.

Figure 13:
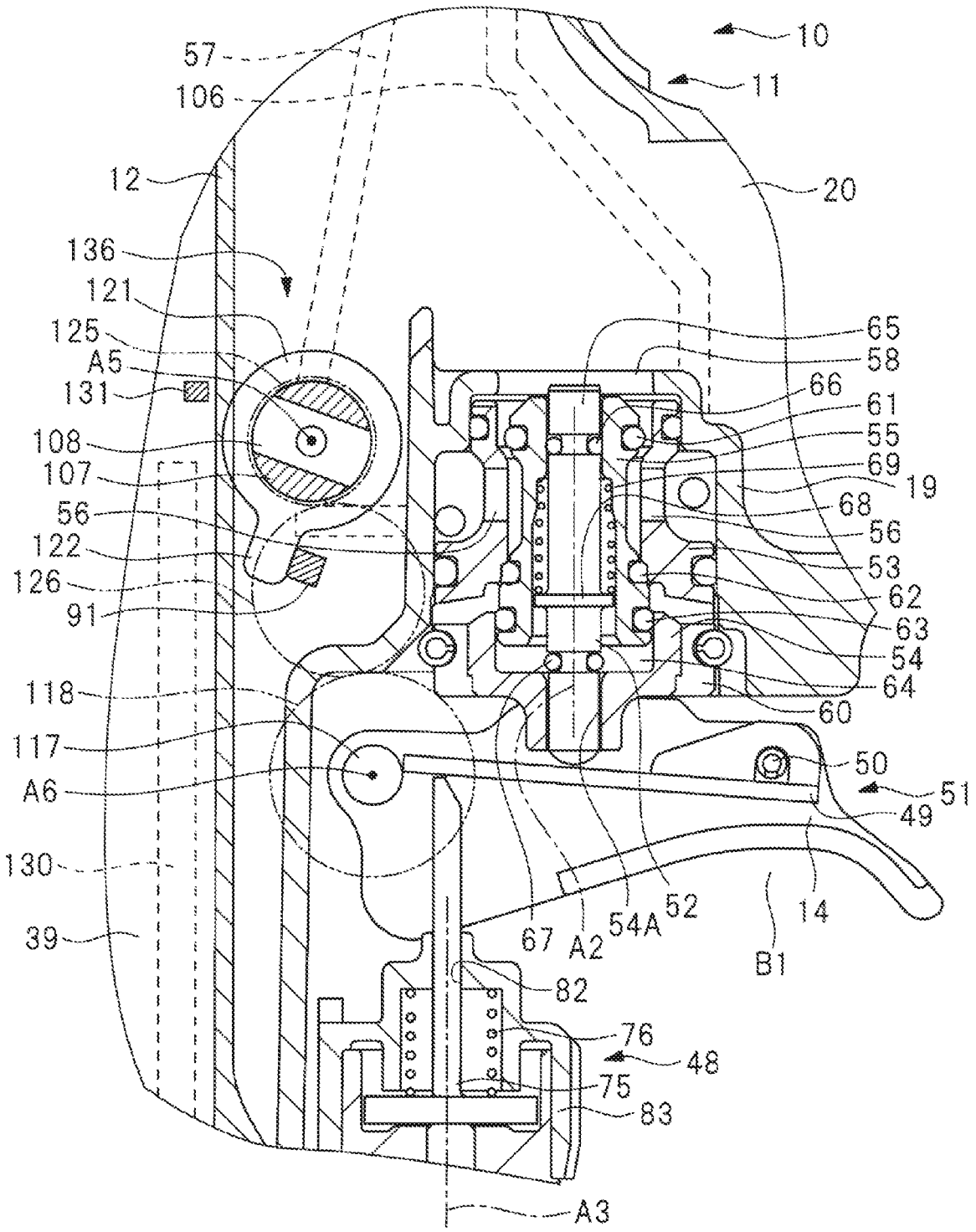
FIG. 13 is a cross-sectional view showing a state in which the second mode is selected and then an operation force is applied to a push lever in the second specific example of the switching mechanism.

When the worker applies the operation force to the trigger 14 and then presses the push lever 16 to the workpiece 77, the arm 49 is rotated by the actuation force of the transmission member 75, the rotational force of the arm 49 is transmitted to the plunger 52, and the plunger 52 is stopped in the actuated state shown in FIG. 13. Then, the valve body 55 is actuated by the pressure of the pressure accumulation chamber 20, the pressure accumulation chamber 20 and the passage 56 are disconnected, and the passage 56 is connected to the outside B1 via the passage 60.

When the control unit 94 determines that the elapsed time from when the operation force is applied to the trigger 14 to when the operation force is applied to the push lever 16 is within the predetermined time, the control unit 94 controls the switch circuit 97 to supply power to the solenoid valve 110, thereby controlling the solenoid valve 110 to be in the state of opening the second ventilation passage 106. Therefore, the compressed air of the control chamber 27 is discharged to the outside via the second ventilation passage 106, the passage 56, and the passage 60. Thus, the striking portion 13 is actuated from the top dead center to the bottom dead center and strikes the nail 73. Note that the timer 98 resets the measured elapsed time and newly starts measuring the elapsed time.

Thereafter, in the state where the operation force is applied to the trigger 14, the worker can drive the nail 73 into the workpiece 77 by alternatively repeating the operation of pressing the push lever 16 to the workpiece 77 and the operation of separating the push lever 16 from the workpiece 77.

On the other hand, when the elapsed time from when the operation force is applied to the trigger 14 exceeds the predetermined time, the control unit 94 controls the switch circuit 97 to stop the current supply to the solenoid valve 110. Namely, the control unit 94 controls the solenoid valve 110 to be in the state of closing the second ventilation passage 106.

Here, as the control by the control unit 94 to stop the current supply to the solenoid valve 110, the fifth control or the sixth control can be selected. The fifth control is to start the current supply to the solenoid valve 110 when an operation force is applied to the trigger 14 and stop the current supply to the solenoid valve 110 when a predetermined time has elapsed. The sixth control is not to supply current to the solenoid valve 110 when the operation force is applied to the trigger 14 and continues to stop the current supply to the solenoid valve 110 even after a predetermined time has elapsed.

Therefore, when the push lever 16 is pressed to the workpiece 77 after a predetermined time has elapsed from when the operation force is applied to the trigger 14, the solenoid valve 110 is in the state of closing the second ventilation passage 106. Accordingly, the compressed air of the control chamber 27 is not discharged to the outside B1 via the second ventilation passage 106. Also, when the second mode is selected, the first valve 107 is in the state of closing the first ventilation passage 57. Thus, the striking portion 13 is stopped at the top dead center, and the striking portion 13 does not strike the nail 73. Note that, when the worker releases the operation force to the trigger 14, the second gear 125 rotates clockwise in FIG. 12 and is stopped at the position in FIG. 8. Therefore, the microswitch 91 disconnects the electric circuit 132 and the control unit 94 is stopped. Namely, the elapsed time measured by the timer 98 is reset.

As described above, in the driver 10 having the switching mechanism 136, the first ventilation passage 57 through which the compressed air is discharged from the control chamber 27 to the outside B1 when the first mode is selected and the second ventilation passage 106 through which the compressed air is discharged from the control chamber 27 to the outside B1 when the second mode is selected are separately provided. Therefore, it is possible to obtain the same effect as that of the driver 10 having the switching mechanism 135.

The technical meanings of the matters disclosed in the embodiments are as follows. The upper piston chamber 36 is an example of a pressure chamber. The nail 73 is an example of a fastener. The striking portion 13 is an example of a striking portion. The trigger 14 is an example of an operation member. The push lever 16 is an example of a contact member. The port 33 is an example of a passage for supplying compressed gas to the pressure chamber. The head valve 31 is an example of a valve body. The control chamber 27 is an example of a control chamber. The first ventilation passage 57 is an example of a first ventilation passage. The second ventilation passage 106 is an example of a second ventilation passage. The first valve 107, the solenoid valve 110, and the control unit 94 are an example of an opening/closing mechanism.

The state in which the first mode is selected, the first valve 107 opens the first ventilation passage 57, and the solenoid valve 110 closes the second ventilation passage 106 is an example of a first state. The state in which the second mode is selected, the first valve 107 closes the first ventilation passage 57, and the solenoid valve 110 opens the second ventilation passage 106 is an example of a second state. The state in which the second mode is selected and the push lever 16 is separated from the workpiece 77 within a predetermined time from when the operation force is applied to the trigger 14, so that the solenoid valve 110 closes the second ventilation passage 106 is an example of a third state.

The first valve 107 is an example of a first valve. The solenoid valve 110 is an example of a second valve. The trigger switch 92, the push lever switch 93, the microswitch 91, and the control unit 94 are an example of a first driving unit. The mode selection member 84 is an example of a mode selection member. The first operation position and the second operation position of the mode selection member 84 are examples of an operation state of the mode selection member. The trigger 14, the support shaft 47, and the arm 49 are an example of a restriction mechanism.

Applying an operation force to the trigger 14 is an example of a first operation. Bringing the push lever 16 into contact with the workpiece 77 is an example of a second operation. The trigger switch 92, the push lever switch 93, and the control unit 94 are an example of a detection unit. The switching mechanisms 135 and 136 are examples of a switching mechanism.

The driver is not limited to the above-described embodiments, and various modifications can be made without departing from the spirit of the invention. For example, the operation member includes an element that is operated linearly by the application of an operation force other than an element that is rotated by the application of an operation force. The examples of the operation member include a lever, a knob, a button, an arm, and the like.

The contact member may be not only a member provided independently of an ejection port of an ejection portion, but also a member provided integrally with the ejection port. The ejection port is formed at the end of the ejection portion. Moreover, examples of the contact member include a lever, an arm, a rod, a plunger, and the like. Further, the contact member may have a tubular shape at a portion in contact with the workpiece or have a plate-like shape through the whole in the direction of the center line A1. The contact member includes a member that is actuated against the force of an elastic member when pressed to the workpiece. The structure in which a contact member is actuated when an operation force is applied to the operation member in the state where the contact member is not pressed to the workpiece may also be applicable.

The control unit or the detection unit may be a single electric component or electronic component, or a unit having a plurality of electric components or a plurality of electronic components. The electric component or the electronic component includes a processor, a control circuit, and a module. The first ventilation passage and the second ventilation passage are paths through which compressed air flows, and include holes, openings, gaps between components, slits, notches, and the like.

As the compressed gas, inert gas such as nitrogen gas or rare gas may be used instead of the compressed air. The striking portion may have either a structure in which the piston and the driver blade are integrally formed or a structure in which the piston and the driver blade that are separately provided are fixed to each other. The fastener includes a nail having a shaft portion and a head portion as well as a nail having a shaft portion and no head portion. The fastener includes a U-shaped pin, a U-shaped screw, and the like. The fastener includes an arbitrary shape and structure that are inserted into the workpiece and fixed to the workpiece. Actuating the striking portion in the direction of striking the fastener does not matter whether the striking portion strikes the fastener.

The solenoid valve may be a keep solenoid valve having a permanent magnet instead of the biasing member. In the keep solenoid valve, the plunger is stopped at a predetermined position by the attraction force of the permanent magnet when no power is supplied. When power is supplied to the keep solenoid valve, the plunger is actuated against the attraction force of the permanent magnet.

Further, by sliding the contact member in contact with the workpiece in the state where the worker selects the first mode and repeating the application and release of the operation force to the operation member while the contact member is in contact with the workpiece, the fastener can be driven by the striking portion.

Further, in the driver 10 having the mode selection member 84, the control unit 94 may be configured to be activated by applying a voltage from the power source 96 to the control unit 94 regardless of the state of the microswitch 91. With this configuration, the control unit 94 can determine that either the first mode or the second mode has been selected at the time when the mode selection member 84 is operated. Also, when the mode selection member 84 is provided, the control unit 94 can determine the selected mode at the time when the trigger 14 or the push lever 16 is operated after the mode selection member 84 is operated. Further, the control unit 94 connects or disconnects the switch circuit 97 according to a signal input from the microswitch 91.

In the driver 10 without the mode selection member 84, the control unit 94 may be configured to be activated by applying a voltage from the power source 96 to the control unit 94 regardless of the state of the microswitch 91. With this configuration, the control unit 94 can determine that either the first mode or the second mode has been selected based on the order of performing the first operation of applying the operation force to the trigger 14 and the second operation of bringing the push lever 16 into contact with the workpiece 77.

Further, the driver includes a driver in which the striking portion is actuated in a direction of striking the fastener by supplying compressed gas to the control chamber through the first ventilation passage or the second ventilation passage. Furthermore, the trigger switch 92, the push lever switch 93, and the microswitch 91 may be contact sensors or non-contact sensors.

It is also possible to define the first mode as a single firing and the second mode as a continuous firing. The single firing and the continuous firing are not distinguished by the time interval when the striking portion is actuated in the direction of striking the fastener. The single firing and the continuous firing are not distinguished by the number of times the striking portion is actuated in the direction of striking the fastener within a predetermined time. The power source includes a DC power source and an AC power source. The DC power source is detachably attached to the main body.

REFERENCE SIGNS LIST

10 . . . driver, 13 . . . striking portion, 14 . . . trigger, 16 . . . push lever, 27 . . . control chamber, 31 . . . head valve, 33 . . . port, 36 . . . upper piston chamber, 47 . . . support shaft, 49 . . . arm, 57 . . . first ventilation passage, 84 . . . mode selection member, 91 . . . microswitch, 92 . . . trigger switch, 93 . . . push lever switch, 94 . . . control unit, 106 . . . second ventilation passage, 107 . . . first valve, 110 . . . solenoid valve, 135, 136 . . . switching mechanism

The invention claimed is:

1. A driver including a pressure chamber, a striking portion actuated in a direction of striking a fastener when compressed gas is supplied to the pressure chamber, an operation member actuated when a worker applies an operation force to the operation member, and a contact member actuated when the worker brings the contact member into contact with a workpiece, the driver having a first mode in which, when the operation member is actuated in a state where the contact member has been actuated, the compressed gas is supplied to the pressure chamber and the striking portion is actuated, and a second mode in which, when the contact member is actuated in a state where the operation member has been actuated, the compressed gas is supplied to the pressure chamber and the striking portion is actuated, the driver comprising:

a passage for supplying the compressed gas to the pressure chamber;

a valve body configured to be actuated and stopped so as to open and close the passage;

a control chamber configured to actuate and stop the valve body according to a pressure of the compressed gas;

a first ventilation passage which is connected to the control chamber and through which the compressed gas passes;

a second ventilation passage which is connected to the control chamber and is disposed in parallel to the first ventilation passage and through which the compressed gas passes; and an opening/closing mechanism configured to open and close each of the first ventilation passage and the second ventilation passage, wherein the opening/closing mechanism has a first state in which the first ventilation passage is opened and the second ventilation passage is closed, a second state in which, the first ventilation passage is closed and the second ventilation passage is opened, and a third state in which, the first ventilation passage is closed and the second ventilation passage is closed, wherein the opening/closing mechanism is in the first state when the driver is in the first mode, wherein the opening/closing mechanism is in the second state when the driver is in the second mode and the contact member is actuated within a predetermined time from when the operation member is actuated, so that the compressed gas is supplied to the pressure chamber through the second ventilation passage and the striking portion is actuated, and wherein the opening/closing mechanism is in the third state when the driver is in the second mode and the predetermined time has elapsed from when the operation member is actuated, so that the compressed gas is not supplied to the pressure chamber.

2. The driver according to claim 1, wherein the opening/closing mechanism includes:

a first valve configured to open and close the first ventilation passage;

a second valve provided separately from the first valve and configured to open and close the second ventilation passage; and a first driving unit configured to detect whether either the first mode or the second mode is selected and control an actuation of the second valve in accordance with the detected mode.

3. The drive according to claim 2, wherein the second valve is actuated to open the second ventilation passage when power is supplied and closes the second ventilation passage when the supplying the power is stopped.

4. The drive according to claim 2, further comprising a mode selection member actuated when the worker applies an operation force and having operation states corresponding to the first mode and the second mode, respectively, wherein the first driving unit detects whether either the first mode or the second mode is selected based on one of the operation states of the mode selection member.

5. The driver according to claim 4, wherein the first valve is actuated by an actuation force of the mode selection member, thereby opening and closing the first ventilation passage.

6. The driver according to claim 1, wherein the striking portion is actuated in the direction of striking the fastener when the first mode is selected and the compressed gas of the control chamber is discharged via the first ventilation passage, and wherein the striking portion is actuated in the direction of striking the fastener when the second mode is selected and the compressed gas of the control chamber is discharged via the second ventilation passage.

7. The driver according to claim 4, further comprising a restriction mechanism configured to prevent the striking portion from being actuated, wherein the restriction mechanism enables the striking portion to be actuated when the operation member is actuated in a state where the first mode is selected and the contact member has been actuated, and wherein the restriction mechanism prevents the striking portion from being actuated when the contact member is actuated in a state where the first mode is selected and the operation member has been actuated.

8. The driver according to claim 2, further comprising a detection unit configured to detect whether either the first mode or the second mode is selected based on an order of performing a first operation in which the worker applies an operation force to the operation member and a second operation in which the worker brings the contact member into contact with the workpiece.

9. The driver according to claim 8, further comprising a switching mechanism configured to switch actuation and stop of the first valve, wherein the switching mechanism actuates the first valve based on the order of performing the first operation and the second operation, and opens and closes the first ventilation passage.

* * * * *